US007760163B2

(12) United States Patent
Jo

(10) Patent No.: US 7,760,163 B2
(45) Date of Patent: Jul. 20, 2010

(54) ELECTRO-OPTICAL DEVICE, DRIVE CIRCUIT, DRIVING METHOD, AND ELECTRONIC APPARATUS

(75) Inventor: Hiroaki Jo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 983 days.

(21) Appl. No.: 11/328,473

(22) Filed: Jan. 10, 2006

(65) Prior Publication Data

US 2006/0158396 A1 Jul. 20, 2006

(30) Foreign Application Priority Data

| | | |
|---|---|---|
| Jan. 17, 2005 | (JP) | 2005-008702 |
| Jan. 19, 2005 | (JP) | 2005-011180 |
| Mar. 17, 2005 | (JP) | 2005-076715 |
| Oct. 26, 2005 | (JP) | 2005-311451 |

(51) Int. Cl.
*G09G 3/30* (2006.01)

(52) U.S. Cl. ..... 345/76; 345/84; 345/89; 345/212

(58) Field of Classification Search ..... 345/84, 345/212, 87, 76, 77
See application file for complete search history.

(56) References Cited

U.S. PATENT DOCUMENTS

| | | | | |
|---|---|---|---|---|
| 6,956,547 | B2 * | 10/2005 | Bae et al. | 345/77 |
| 7,012,597 | B2 | 3/2006 | Kasai | |
| 7,145,531 | B2 | 12/2006 | Jo | |
| 7,245,276 | B2 | 7/2007 | Yamada | |
| 7,256,756 | B2 | 8/2007 | Abe | |
| 7,489,310 | B2 | 2/2009 | Kasai | |
| 2004/0239668 | A1 * | 12/2004 | Morosawa et al. | 345/212 |
| 2007/0206031 | A1 | 9/2007 | Yamada | |
| 2007/0206032 | A1 | 9/2007 | Yamada | |
| 2007/0217275 | A1 | 9/2007 | Abe | |

FOREIGN PATENT DOCUMENTS

| | | |
|---|---|---|
| CN | 1523557 A | 8/2004 |
| JP | A-2003-195812 | 7/2003 |
| JP | A-2003-233347 | 8/2003 |
| JP | A-2004-4790 | 1/2004 |
| JP | A-2004-088158 | 3/2004 |
| JP | A-2004-349814 | 12/2004 |
| KR | A-2004-101936 | 12/2004 |

* cited by examiner

*Primary Examiner*—Henry N Tran
*Assistant Examiner*—Viet Pham
(74) *Attorney, Agent, or Firm*—Oliff & Berridge, PLC

(57) ABSTRACT

A drive circuit of an electro-optical device comprising electro-optical elements of which each gray scale is controlled in accordance with a data signal output to a data line includes a reference current that generates unit generating reference current and a signal output unit that generates the data signal corresponding to a current value of the reference current generated by the reference current generating unit on the basis of gray-scale data and outputs the generated data signal to the data line. The reference current generating unit performs a refresh operation of setting the current value of the reference current to a predetermined value plural times.

17 Claims, 26 Drawing Sheets

FIRST PERIOD $P_1$

SECOND PERIOD $P_2$

THIRD PERIOD $P_3$

FOURTH PERIOD $P_4$

PERIOD $P_0$

FIRST PERIOD $P_1$

SECOND PERIOD $P_2$

THIRD PERIOD $P_3$

FOURTH PERIOD $P_4$

FIFTH PERIOD $P_5$

ELECTRO-OPTICAL DEVICE, DRIVE CIRCUIT, DRIVING METHOD, AND ELECTRONIC APPARATUS

The entire disclosure of Japanese Patent Application Nos: 2005-011180, filed Jan. 19, 2005, 2005-008702, filed Jan. 17, 2005, 2005-076715, filed Mar. 17, 2005, and 2005-311451, filed Oct. 26, 2005 are expressly incorporated by reference herein.

BACKGROUND

1. Technical Field

The present invention relates to a technique of controlling a variety of electro-optical elements such as organic light emitting diode (hereinafter, referred to as "OLED") elements.

2. Related Art

An electro-optical device having such a kind of electro-optical elements includes a plurality of electro-optical elements arranged in a planar shape corresponding to a plurality of data lines and a plurality of current output circuits generating data signals on the basis of digital data (hereinafter, referred to as "gray-scale data") defining gray scales of the electro-optical elements and outputting the data signals to the data lines. Each current output circuit has a function as a digital-to-analog converter including a plurality of transistors (hereinafter, referred to as "current supply transistors") serving as a current source and generates the data signals by adding current flowing in one current supply transistor selected in accordance with the gray-scale data among the current supply transistors.

Errors may occur in characteristics (specifically, threshold voltage) of the plurality of current supply transistors included in each current output circuit due to reasons in manufacture. In this way, when deviation occurs in characteristics of the current supply transistors, the current supply transistors cannot generate the data signals having a predetermined current value corresponding to the gray-scale data. As a result, there is a problem that display quality is deteriorated.

In order to solve the problem, a configuration that a circuit (hereinafter, referred to as a "compensation circuit") compensating for the deviation in characteristics of the current supply transistors is disposed in each current output circuit is disclosed in JP-A-2004-88158 (see paragraph 0053 and FIG. 3). Each compensation circuit includes a transistor (hereinafter, referred to as "compensation transistor") of which the drain terminal and the gate terminal are connected to each other and a capacitor holding the voltage of the gate terminal thereof. The compensation transistor has substantially the same characteristic as the respective current supply transistors. When the voltage (hereinafter, referred to as "reference voltage") of the gate terminal of the compensation transistor which has been temporarily turned on is supplied to the gate terminal of the respective current supply transistors, the errors of the current supply transistors are compensated for.

However, when the reference voltage is once varied due to noises or the like, the voltage of the gate terminal of the compensation transistor is kept with the level after the variation. Accordingly, there is a problem in that the reference voltage with a predetermined level cannot be supplied to the gate terminals of the current supply transistors and thus it is difficult to control the data signals in a desired current value.

SUMMARY

In consideration of such circumstances, an advantage of the present invention is to generate the data signals stably.

According to an aspect of the present invention, there is provided a drive circuit of an electro-optical device comprising electro-optical elements of which each gray scale is controlled in accordance with a data signal output to a data line. The driving circuit comprises: a reference current generating unit that generates a reference current; and a signal output unit that generates the data signal corresponding to a current value of the reference current on the basis of gray-scale data and outputs the generated data signal to the data line. The reference current generating unit performs a refresh operation of setting the current value of the reference current to a predetermined value plural times.

According to this configuration, since the refresh operation is performed plural times. Accordingly, even when the reference current is changed due to a noise, the reference current is set to a predetermined value through the next refresh operation. As a result, it is possible to stably generate the data signal corresponding to the gray-scale data with high accuracy. In the invention, the configuration that the signal output unit "generates the data signal corresponding to the current value of the reference current" includes a configuration that the data signal corresponding to a voltage (reference voltage) generated based on the current value of the reference current is generated, as well as a configuration that the data signal directly reflecting the current value of the reference current is generated.

In the drive circuit according to a first aspect of the invention, the reference current generating unit may comprise: a compensation transistor (for example, a compensation transistor Ta in FIG. 3) of which a first terminal is supplied with a voltage and of which a second gate terminal and a gate terminal are electrically connected to each other; a capacitor (for example, a capacitor C1 in FIG. 3) that holds the voltage of the gate terminal of the compensation transistor; and a voltage supply circuit (for example, a voltage supply line 27 and a switching element SW in FIG. 3) that performs the refresh operation of supplying a ON voltage allowing the compensation transistor to be turned on to the gate terminal of the compensation transistor plural times. The reference current generating unit may generate the reference current (for example, reference current Ir0 in FIG. 3) corresponding to the voltage held by the capacitor. According to the first aspect, the reference current is set to a predetermined current value by supplying the ON voltage to the gate terminal of the compensation transistor. A specific example of the first aspect is described later as a first embodiment.

The drive circuit according to the first aspect may further comprise a conversion unit that generates a reference voltage (for example, a reference voltage Vref1 in FIG. 3) corresponding to the reference current. The reference current generating unit may include a current generating transistor (for example, a current generating transistor Tb in FIG. 3) that generates the reference current by supplying the voltage held by the capacitor to the gate terminal. The signal output unit may generate the data signal corresponding to the reference voltage generated by the conversion unit on the basis of the gray-scale data and may output the generated data signal to the data line. The conversion unit according to this aspect may include a current mirror circuit that generates mirror current (for example, mirror current Ir1 in FIG. 3) corresponding to the reference current generated by the current generating transistor and a circuit (for example, a voltage generating transistor Td in FIG. 3) that generates the reference voltage corresponding to the mirror current generated by the current mirror circuit. According to this aspect, since the current generating transistor and the conversion unit are interposed between the gate terminal of the compensation transistor and the signal output unit, the reference voltage supplied to the signal output unit can be satisfactorily stabilized. In this configuration, in order to satisfactorily compensate for the deviation in threshold voltage of the current generating transistor, it is preferable that the current generating transistor and the compensation transistor have approximately the same characteristic. Above all, the advantages of the invention can be effectively obtained even when the characteristics of the transistors are strictly equal to each other.

The drive circuit according to the first aspect may further comprise a comparison unit that compares the voltage of the gate terminal of the compensation transistor with a predetermined voltage. The voltage supply circuit may supply the ON voltage to the gate terminal of the compensation transistor at the time corresponding to the comparison result of the comparison unit. For example, the predetermined voltage may be a voltage between the voltage supplied to the first terminal of the compensation transistor and a voltage (for example, a voltage Va in a first embodiment) obtained by adding a threshold voltage of the compensation transistor to the voltage supplied to the first terminal thereof. According this aspect, only when the voltage of the gate terminal of the compensation transistor is changed, the ON voltage can be supplied to the gate terminal. Accordingly, the power consumption is reduced, compared with the configuration that the ON voltage is regularly supplied to the gate terminal of the compensation transistor. In addition, a specific example of this configuration is shown in FIG. 7.

In a second aspect of the invention, the reference current generating unit may include: a current generating transistor (for example, a current generating transistor TrA in FIG. 11) having a gate terminal, a first terminal, and a second terminal; and a capacitor (for example, a capacitor C1 in FIG. 11) that holds the voltage of the gate terminal of the current generating transistor. Here, the refresh operation may include: a compensation operation of setting the voltage of the gate terminal to a voltage value based on a first voltage (for example, a voltage Vref in FIG. 11) and a threshold voltage of the current generating transistor by supplying the first voltage to the second terminal (a source terminal in FIG. 11) in the state where the gate terminal is electrically connected to the first terminal (for example, a drain terminal in FIG. 11) and then allowing the capacitor to hold the set voltage; and a generation operation of generating the reference current (for example, current Ir1 in FIG. 11) corresponding to the voltage held by the capacitor in the compensation operation between the first terminal and the second terminal, by supplying a second voltage (for example, a voltage Vdd of FIG. 11) different from the first voltage to the second terminal in the state where the gate terminal is electrically disconnected from the first terminal.

According to this aspect, it is possible to compensate for the error in threshold voltage through the use of the compensation operation of setting the voltage of the gate terminal of the current generating transistor to the voltage value corresponding to the threshold voltage. For example, the reference current generated by the current generating transistor is determined based on the gain coefficient or the difference value between the first voltage and the second voltage, but not relies on the threshold voltage. Accordingly, it is possible to stably generate the reference current adjusted to the predetermined current value with high accuracy by performing the refresh operation plural times. A specific example of this configuration is described later as a second embodiment.

In the drive circuit according to the second aspect, the compensation operation may include: a first operation of supplying the first voltage to the second terminal and supplying a predetermined voltage to the gate terminal in the state where the gate terminal and the first terminal are electrically connected to each other in a first period (for example, a period A in FIG. 12); and a second operation of setting the voltage of the gate terminal to a voltage value based on the first voltage and a threshold voltage of the current-generating transistor by stopping the application of the predetermined voltage to the gate terminal in the state where the gate terminal and the first terminal are electrically connected to each other and allowing the capacitor to hold the set voltage in a second period (for example, a period B in FIG. 12) successive to the first period. Here, the generation operation may include: a third operation of electrically disconnecting the gate terminal and the first terminal from each other in a third period (for example, a period C in FIG. 12) successive to the second period; and a fourth operation of generating the reference current corresponding to the voltage held by the capacitor between the first terminal and the second terminal by supplying the second voltage to the second terminal in a fourth period (for example, a period D in FIG. 12) successive to the third period. The same operations and advantages can be obtained from this configuration.

In the drive circuit according to the second aspect, the reference current generating unit may include a plurality of the current generation transistors (for example, current generating transistors TrA1 to TrA4 in FIG. 21) of which the gate terminals are connected to the capacitor in common. The signal output unit for example, transistors TrD1 to TrD4 in FIG. 21) may select one or more current generating transistors among the plurality of current generating transistors in accordance with gray-scale data and may output the total current flowing between the first terminal and the second terminal in the one or more current generating transistors as a data signal. According to this configuration, the kinds of reference current generated by the plurality of current generating transistors are selectively output as the data signal in accordance with the gray-scale data. A specific example of this configuration is shown in FIG. 21.

The reference current generating unit may include a voltage generating transistor in which the voltage of a gate terminal thereof is set to a reference voltage in accordance with the reference current flowing between a first terminal supplied with a third voltage (for example, a ground potential Gnd in FIG. 11) and a second terminal connected to the gate terminal. The signal output unit may generate a data signal corresponding to the reference voltage of the gate terminal of the voltage generating transistor (for example, a voltage generating transistor TrB in FIG. 11) on the basis of the gray-scale data and may output the generated data signal to the data line. The first operation may include an operation of setting the voltage of the gate terminal of the current generating transistor to the predetermined voltage (for example, a voltage obtained by dividing a voltage Vref in FIG. 11 in accordance with a resistance ratio between the current generating transistor TrA and the voltage generating transistor TrB) in accordance with an ON resistance ratio between the current generating transistor and the voltage generating transistor, the first voltage, and the third voltage, by electrically connecting the first terminal of the current generating transistor and the second terminal of the voltage generating transistor. The second operation may include an operation of stopping the supply of the predetermined voltage by electrically disconnecting the first terminal of the current generating transistor and the second terminal of the voltage generating transistor from each other. According to this configuration, it is possible to stably generate the reference current adjusted to the predetermined current value with high accuracy by performing the refresh operation plural times.

In the drive circuit according to the second aspect, the second period may be shorter than a period of time until the voltage of the gate terminal of the current generating transistor is changed from the predetermined voltage set in the first period to a difference value between the first voltage and the threshold voltage of the current generating transistor. According to this configuration, it is possible to shorten the time for compensation operation of compensating for the deviation in threshold voltage of the current generating transistor.

In the drive circuit according to the second aspect, the second period may be longer than a period of time until the voltage of the gate terminal of the current generating transistor is changed from the predetermined voltage set in the first period to a difference value between the first voltage and the threshold voltage of the current generating transistor. According to this configuration, it is possible to satisfactorily compensate for the deviation in threshold voltage of the current generating transistor.

The drive circuit according to a third aspect of the invention may further comprise: a current generating transistor (for example, a current generating transistor TrA in FIG. 22) having a gate terminal, a first terminal, and a second terminal supplied with a predetermined voltage (for example, a power source potential Vdd in FIG. 22); and a capacitor (for example, a capacitor C2 in FIG. 22) having a first electrode (for example, a first electrode E1 in FIG. 22) and a second electrode (for example, a second electrode E2 in FIG. 22) connected to the gate terminal of the current generating transistor. Here, the refresh operation may include: a compensation operation of supplying a voltage based on the predetermined voltage and a threshold voltage of the current generating transistor to the second electrode, by electrically connecting the gate terminal and the first terminal of the current generating transistor to each other in the state where a first voltage (for example, a voltage VINI in FIG. 22) is supplied to the first electrode; and a generation operation of changing the voltage of the second terminal on the basis of a difference between the first voltage and a second voltage from the voltage set in the compensation operation by switching the voltage of the first electrode to the second voltage different from the first voltage in the state where the gate terminal and the first terminal (a drain terminal in FIG. 22) of the current generating transistor are electrically disconnected from each other and then generating the reference current (a reference current Ir0 in FIG. 22) corresponding to the changed voltage of the second terminal between the first terminal and the second terminal.

According to the third aspect, it is possible to compensate for the error of the threshold voltage through the use of the compensation operation of setting the voltage of the gate terminal of the current generating transistor to the voltage value corresponding to the threshold voltage. When the voltage of the first electrode is changed from the first voltage to the second voltage, the voltage of the gate terminal of the current generating transistor is changed based on the difference between the first voltage and the second voltage, through the use of the capacitive coupling of the capacitor. Accordingly, it is possible to stably generate the reference current adjusted to the predetermined current value with high accuracy in accordance with the first voltage and the second voltage by performing the refresh operation plural times. A specific example of this aspect is described as a third embodiment.

In the drive circuit according to the third aspect, the compensation operation may include: a first operation of supplying the first voltage to the first electrode and supplying a third voltage (for example, a ground potential Gnd in FIG. 25) to the second electrode in the state where the second electrode and the gate terminal of the current generating transistor are electrically disconnected from each other in a first period (for example, a period P0 in FIG. 26); a second operation of connecting the second electrode to the gate terminal of the current generating transistor after stopping the supply of the third voltage to the second electrode in a second period (for example, a period P1 in FIG. 26) successive to the first period; and a third operation of setting the voltage of the second electrode to a voltage (for example, a voltage "Vdd−Vth" in FIG. 26) in accordance with the predetermined voltage and the threshold voltage of the current generating transistor by connecting the gate terminal and the first terminal of the current generating transistor to each other in a third period (for example, a period P2 in FIG. 26) successive to the second period. The generation operation may include: a fourth operation of electrically disconnecting (that is, releasing the diode connection) the gate terminal and the first terminal of the current generating transistor from each other in a fourth period (for example, a period P3 in FIG. 26) successive to the third period; and a fifth operation of generating the reference current between the first terminal and the second terminal by changing the voltage of the first electrode to the second voltage in a fifth period (for example, a period P4 in FIG. 26) successive to the fourth period. According to this configuration, since the voltage of the gate terminal of the current generating transistor is not lowered to the third voltage before the compensation of the threshold voltage, the power consumption in the current generating transistor can be reduced and the tie until the voltage of the gate terminal reaches the voltage value for compensating for the error of the threshold voltage can be reduced.

The drive circuit according to the first to third aspects may comprise a plurality of unit circuits of which each includes the reference current generating unit and the signal output unit (for example, see FIG. 3 or 11). According to this configuration, it is possible to generate the reference current with high accuracy for each signal output unit. However, The drive circuit may comprise a plurality of the signal output units of which each generates the data signal corresponding to the reference voltage generated by one reference current generating unit (for example, see FIG. 5 or 17). According to this configuration, since one current generating unit is shared by a plurality of signal output units, the circuit size can be reduced in comparison with the configuration that each unit circuit includes the reference current generating unit and the signal output unit.

The drive circuit according to the first to third aspects may comprise a plurality of the reference current generating units; and a selection unit (for example, a selection circuit 29 in FIG. 8 or 18) selecting any of the plurality of reference current generating units. The signal output unit may generate the data signal corresponding to the reference current generated by the reference current generating unit selected by the selection unit on the basis of gray-scale data and may output the generated data signal to the data line. According to this configuration, the reference current generated from any one reference current generating unit is selectively employed for generating the data signal. For example, when the reference current generated from any one reference current generating unit is changed, the data signal is generated on the basis of the reference current generated by another reference current generating unit. Therefore, it is possible to stably supply the reference voltage to the signal output units. A specific example of this configuration is shown in FIG. 8 or 18.

It is preferable that each of the plurality of reference current generating units performs the refresh operation at the times different from each other. According to this configuration, when any one reference current generating unit performs the refresh operation, the reference current of another reference current generating unit is selected by the selection unit, thereby generating the data signal more stably.

Specifying this configuration within the drive circuit according to the first aspect, the drive circuit may comprise a plurality of voltage generating units (for example, a reference voltage generating circuit 21 in FIG. 8) generating a voltage, a selection unit (for example, a selection circuit 29 in FIG. 8) selecting the voltage generated by any one of the plurality of voltage generating units, and a current output unit generating a data signal corresponding to the reference voltage selected by the selection unit on the basis of the gray-scale data and outputting the data signal to the data lines. Each voltage generating unit may include a compensation transistor of which the first terminal is supplied with a voltage and of which the second terminal and the gate terminal are connected to each other, a capacitor (voltage holding unit) holding the voltage of the gate terminal of the compensation transistor, and a voltage supply unit supplying the ON voltage turning on the compensation transistor to the gate terminal of the compensation transistor plural times, and serves to outputs the voltage held by the capacitor or a voltage corresponding to the voltage as a reference voltage. More specifically describing, the voltage supply unit of the respective voltage generating units included in one unit circuit supplies the ON voltage to the gate terminal of the compensation transistor of the corresponding voltage generating unit at the times difference from each other and the selection unit sequentially selects the reference voltage generated by the voltage generating unit of which the compensation transistor is supplied with the ON voltage.

In the drive circuit according to the first to third aspects of the invention, the reference current generating unit may perform the refresh operation every predetermined time. According to this configuration, even when the reference current is changed accidentally at any time, the reference current can be satisfactorily corrected through the next refresh operation.

The reference current generating unit may perform the refresh operation in a blanking period between successive horizontal scanning periods or in a blanking period between successive vertical scanning periods. According to this configuration, it is possible to prevent the refresh operation (for example, supplying the ON voltage to the gate terminal of the compensation transistor in the first aspect) from affecting the gray scales of the electro-optical device.

It is more preferable that the reference current generating unit performs the refresh operation at the time before the signal output unit starts its operation and at the time after the signal output unit starts its operation. According to this configuration, since the refresh operation is performed before starting the operation of the signal output unit, it is possible to stably generate the data signal with high accuracy from the time when the signal output unit starts its operation. In addition, since the refresh operation is performed after the operation of the signal output unit is started, it is possible to correct the reference current to a predetermined value even when the reference current is changed during the operation of the signal output unit.

The invention may be specified as an electro-optical device having the drive circuit according to the above-mentioned aspects. The electro-optical device comprises: a plurality of electro-optical elements of which each gray scale is controlled in accordance with a data signal output to a data line; and the drive circuit according to any one aspect described above. In the drive circuit according to the invention, since the current value of the reference current (or the voltage value of the reference voltage generated corresponding to the reference current) is kept stable, an image with high quality can be output from the electro-optical device employed in a display or an image forming apparatus (printer).

The electro-optical device according to the invention is used for a variety of electronic apparatus. A typical example of the electronic apparatus is an apparatus employing the electro-optical device as a display unit. Examples of such an electronic apparatus can include a personal computer, a mobile phone, and the like. Above all, the application of the electro-optical device according to the invention is not limited to the display of an image. For example, the electro-optical device according to the invention can apply to an exposure unit (an exposure head) for forming a latent image on an image carrier such as a photosensitive drum by the use of irradiation of rays.

The invention may be specified as a method of driving an electro-optical device. That is, the method is a driving method of an electro-optical device having a plurality of electro-optical elements of which each gray scale is controlled in accordance with a data signal output to a data line, a reference current generating unit that generates reference current, and a signal output unit that generates the data signal corresponding to a current value of the reference current generated by the reference current generating unit on the basis of gray-scale data and outputs the generated data signal to the data line, wherein a refresh operation of setting the current value of the reference current to a predetermined value is performed plural times. According to the method, it is possible to stably generate the reference current (or a reference voltage generated on the basis of the reference current) by performing the refresh operation plural times. The driving method according to the invention may employ the aspects exemplified for the drive circuit, similarly.

Specifically, paying attention to the configuration for preventing errors of the reference current (or a reference voltage generated on the basis of the reference current), the invention may be specified as a drive circuit according to any one of the following aspects. The drive circuits may appropriately employ the aspects described above.

In a first feature of the drive circuit according to the invention, the drive circuit may include: a voltage generating unit (for example, reference voltage generating circuit 21 in FIG. 3 or 5) generating a reference voltage; and a signal output unit (for example, current output circuit 23 in FIG. 3 or 5) generating a data signal corresponding to a reference voltage generated by the voltage generating unit on the basis of gray-scale data and outputting the generating data signal to the data line. The voltage generating unit may include: a compensation transistor of which a first terminal is supplied with a voltage and of which a second terminal and a gate terminal are connected to each other; a capacitor unit (for example, capacitor C1 in FIG. 3 or 5) holding the voltage of the gate terminal of the compensation transistor; and a voltage supply circuit (for example, switch SW in FIG. 3 or 5) supplying an ON voltage for turning on the compensation transistor to the gate terminal of the compensation transistor, and may output the voltage held by the capacitor unit or a voltage corresponding to the voltage as the reference voltage.

In a second feature of the drive circuit according to the invention, a drive circuit of an electro-optical device having a plurality of electro-optical elements which are controlled in accordance with a data signal, which is supplied through one of a plurality of data lines and defines a gray scale, includes a current generating transistor for generating data current as the data signal or reference current serving as a basis of the data current and a capacitor for holding the voltage of the gate terminal of the current generating transistor. Supposed that the voltage supplied to a first terminal of the current generating transistor so as to generate the data current or the reference current is a first voltage and the voltage supplied to the first terminal in the state where the gate terminal and a second terminal of the current generating transistor are connected to each other so as to determine the gate voltage as a voltage value of the gate terminal of the current generating transistor is a second voltage, the data current or the reference current, which is determined on the basis of a gain coefficient of the current generating transistor and a voltage difference between the first voltage and the second voltage, is generated by the current generating transistor, by disconnecting the gate terminal and the second terminal of the current generating transistor from each other and changing the voltage supplied to the first terminal of the current generating transistor from the second voltage to the first voltage in the state where the gate voltage of the gate terminal of the current generating transistor is held by the capacitor.

According to another aspect of the invention, there is provided a drive circuit of an electro-optical device having a plurality of electro-optical elements of which gray scales are controlled in accordance with a data signal supplied through a data line, the drive circuit including a voltage generating unit for generating a reference voltage and a current output unit for generating the data signal corresponding to the reference voltage generated by the voltage generating unit on the basis of gray-scale data and outputting the data signal to the data line. The voltage generating unit includes a compensation transistor of which a first terminal is supplied with a voltage and of which a second terminal and a gate terminal are connected to each other, a capacitor for holding the voltage of the gate terminal of the compensation transistor, and a voltage supply unit for supplying an ON voltage turning on the compensation transistor to one end of a resistor of which the other end is connected to the gate terminal of the compensation transistor and outputs the voltage held by the capacitor or a voltage corresponding to the voltage as a reference voltage. According to this aspect, since it is not necessary to supply the ON voltage to the gate terminal of the compensation transistor at a specific time, the configuration of the drive circuit can be simplified. A specific example of this aspect is shown in FIG. 10. The above-described configurations can be employed in the drive circuit according to this aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A-1. Configuration of First Embodiment

Figure 1:
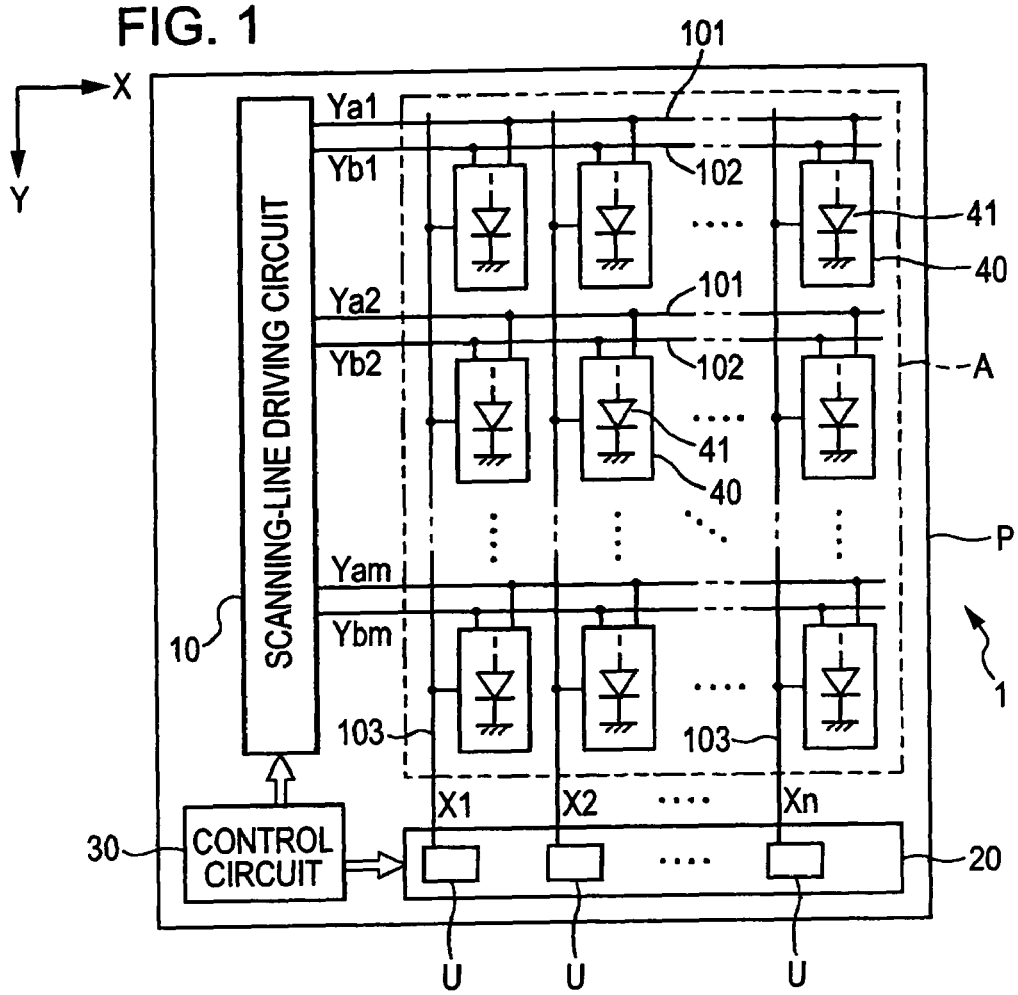
FIG. 1 is a block diagram illustrating a configuration of an electro-optical device according to a first embodiment of the present invention.

FIG. 1 is a block diagram illustrating a configuration of an electro-optical device according to a first embodiment of the present invention. As shown in FIG. 1, the electro-optical device 1 includes an electro-optical panel AA, a scanning-line driving circuit 10, a data-line driving circuit 20, and a control circuit 30. A pixel area P is formed on the electro-optical panel AA. In the pixel area P, m scanning lines 101 extending in the X direction (row direction) and m light-emission control lines 102 extending in the X direction to form pairs together with the scanning lines 101 are formed (where m is a natural number). In addition, n data lines 103 extending in the Y direction (column direction) perpendicular to the X direction are formed in the pixel area P (where n is a natural number). Pixel circuits 40 are arranged to correspond to intersections between the pairs of the scanning lines 101 and the light-emission control lines 102 and the data lines 103. Accordingly, the pixel circuits 40 are arranged in a matrix shape in the X direction and the Y direction in the pixel area P. Each pixel circuit 40 includes an OLED element 41 which is a current driven type self-light-emitting element.

The control circuit 30 is a circuit for controlling operations of the electro-optical device 1 and serves to output various control signals (for example, enable signal SENB or control signal SINI to be described later) such as a clock signal to the scanning-line driving circuit 10 or the data-line driving circuit 20. The control circuit 30 outputs gray-scale data D to the data-line driving circuit 20. The gray-scale data D are 4-bit digital data specifying a gray scale (brightness) of the respective OLED element 41.

The scanning-line driving circuit 10 is a circuit for sequentially selecting the m scanning lines 101. More specifically speaking, the scanning-line driving circuit 10 outputs scanning signals Ya1, Ya2, . . . , Yam, which are sequentially switched to a high level every horizontal scanning period, to the scanning lines 101 and outputs light-emission control signals Yb1, Yb2, . . . , Ybm, which are obtained by inverting logical levels of the scanning signals, to the light-emission control lines 102. When the scanning signal Yai (where i is an integer satisfying $1 \leqq i \leqq m$) is changed to a high level, the i-th row is selected.

On the other hand, the data-line driving circuit 20 supplies data signals X1, X2, . . . , Xn to the respective pixel circuits 40 connected to the scanning lines 101 selected by the scanning-line driving circuit 10. The data signal Xj (where j is an integer satisfying $1 \leqq j \leqq n$) is a current signal specifying brightness (gray scale) of the pixel circuits 40 in the j-th column. In the first embodiment, the data-line driving circuit 20 includes n unit circuits U corresponding to the total number of the data lines 103. The j-th unit circuit U generates the data signal Xj on the basis of the gray-scale data D of the pixel circuit 40 in the j-th column and outputs the generated data signal to the corresponding data line 103. The scanning-line driving circuit 10, the data-line driving circuit 20, or the control circuit 30 may be mounted on the electro-optical panel AA through the use of, for example, a COG (Chip On Glass) technology or may be mounted on the outside (for example, on a wiring substrate mounted on the electro-optical panel AA) of the electro-optical panel AA.

Next, a configuration of a pixel circuit 40 will be described with reference to FIG. 2. Only one pixel circuit 40 in the i-th row and the j-th column is shown in the figure, but other pixel circuits 40 have the same configuration. In the first embodiment, the pixel circuit 40 is a current-driven type (so-called current programming type) circuit in which the brightness (gray scale) of the OLED element 41 is controlled in accordance with the current value of the data signal Xj.

Figure 2:
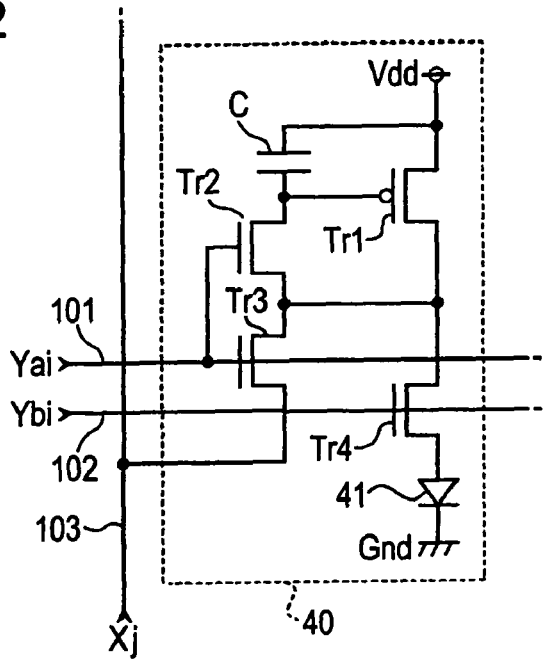
FIG. 2 is a circuit diagram illustrating a configuration of a pixel circuit.

As shown in FIG. 2, the pixel circuit 40 includes four transistors (for example, thin film transistors) Tr1 to Tr4, a capacitor C, and an OLED element 41. The conduction type of the transistor Tr1 is a p channel type and the conduction type of the transistors Tr2 to Tr4 are an n channel type. The source terminal of the transistor Tr1 is connected to a power supply line supplied with a high potential of a power source (hereinafter, referred to as "power source potential") Vdd and the drain terminal is connected to the source terminal of the transistor Tr2, the drain terminal of the transistor Tr3, and the drain terminal of the transistor Tr4.

An end of the capacitor C is connected to the source terminal of the transistor Tr1 and the other end is connected to the gate terminal of the transistor Tr1 and the drain terminal of the transistor Tr2. The gate terminal of the transistor Tr3 is connected to the scanning line 101 together with the gate terminal of the transistor Tr2 and the source terminal thereof is connected to the data line 103. On the other hand, the gate terminal of the transistor Tr4 is connected to the light-emission control line 102 and the source terminal thereof is connected to a positive electrode of the OLED element 41. The negative electrode of the OLED element 41 is connected to a ground line supplied with a low potential of a power source (hereinafter, referred to as "ground potential") Gnd.

When the scanning signal Yai is changed to a high level in the i-th horizontal scanning period of each vertical scanning period, the transistor Tr2 is turned on so that the transistor Tr1 is connected in a diode type and the transistor Tr3 is also turned on. Accordingly, the current corresponding to the data signal Xj flows a path of the power supply line→the transistor Tr1→the transistor Tr3→the data line 103. At this time, electric charges corresponding to the potential of the gate terminal of the transistor Tr1 are accumulated in the capacitor C.

Next, when the i-th horizontal scanning period is ended and the scanning signal Yai is changed to a low level, the transistors Tr2 and Tr3 are all turned off. At this time, the gate-source voltage of the transistor Tr1 is held as a voltage in the right-previous horizontal scanning period. When the light-emission control signal Ybi is changed to a high level, the transistor Tr4 is turned on, current (that is, current corresponding to the data signal Xj) corresponding to the gate voltage flows between the source and drain terminals of the transistor Tr1 from the power supply line, and the OLED element 41 emits light by means of supply of the current.

Figure 3:
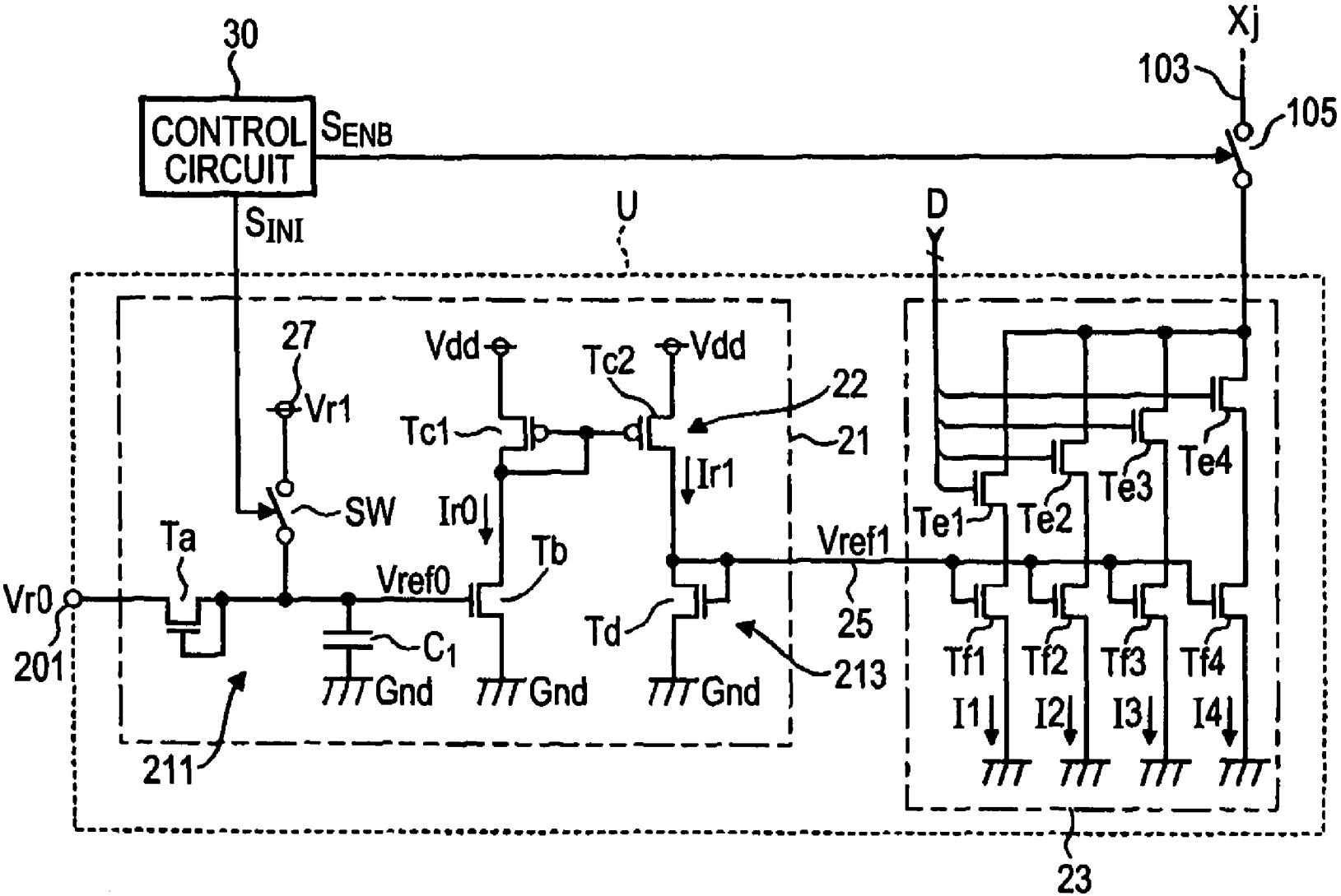
FIG. 3 is a circuit diagram illustrating a configuration of a data-line driving circuit.

Next, FIG. 3 is a circuit diagram illustrating a specific configuration of a unit circuit U included in the data-line driving circuit 20. In the figure, only the configuration of the j-th column unit circuit U, but other unit circuits U have the same configuration. As shown in FIG. 3, each unit circuit U has a reference voltage generating circuit 21 and a current output circuit 23 connected to each other through a reference voltage line 25.

Each current output circuit 23 serves as a digital-to-analog converter generating the data signal Xj with a current value corresponding to the gray-scale data D supplied from the control circuit 30 and outputting the generated data signal to the data line 103 and includes four transistors Te (Te1 to Te4) corresponding to the number of bits of the gray-scale data D and four transistors Tf (Tf1 to Tf4) of which respective drain terminals are connected to the source terminal of a transistor Tb. The gate terminals of the transistors Tf are connected in common to the reference voltage line 25. The source terminals of the transistors Tf are connected to the ground line supplied with the ground potential Gnd.

The characteristics (specifically, gain coefficient) of the transistors Tf1 to Tf4 are set such that the ratio between the current I1 to I4 flowing in the respective transistors Tf is "I1:I2:I3:I4=1:2:3:4" when a common voltage is supplied to the gate terminals. That is, the transistors Tf1 to Tf4 serve as current sources generating a plurality of current I1 to I4 weighted with different weighting values.

The characteristics of the respective transistors Tf may be determined such that the ratio between the current I1 to I4 is power of two (for example, "I1:I2:I3:I4=1:2:4:8"). Also, by disposing transistors having the same size as many as the number corresponding to the weighting values in parallel, the ratio between the current I1 to I4 can be set with the size corresponding to the weighting values. For example, when two transistors having the same characteristic as the transistor Tf1 are disposed in parallel instead of the transistor Tf2 shown in FIG. 3, four transistors connected to each other in parallel are disposed instead of the transistor Tf3, and eight transistors connected to each other in parallel are disposed instead of the transistor Tf3, the ratio between the current I1 to I4 can be set to "I1:I2:I3:I4=1:2:4:8". According to this configuration, it is possible to reduce the deviation in threshold voltage of the respective transistors, thereby generating the data signal Xj corresponding to predetermined current with high accuracy.

The gate terminals of the transistors Te1 to Te4 are supplied with respective bits of the gray-scale data D output from the control circuit 30. The drain terminals of the transistors Te1 to Te4 are connected to the j-th data line 103 through the switching element 105. The switching element 105 serves to control the output of the data signal Xj to the data lines 103. The switching of all the switching elements 105 disposed at the rear stage of the respective unit circuits U is controlled in accordance with an enable signal SENB supplied in common from the control circuit 30.

Figure 4:
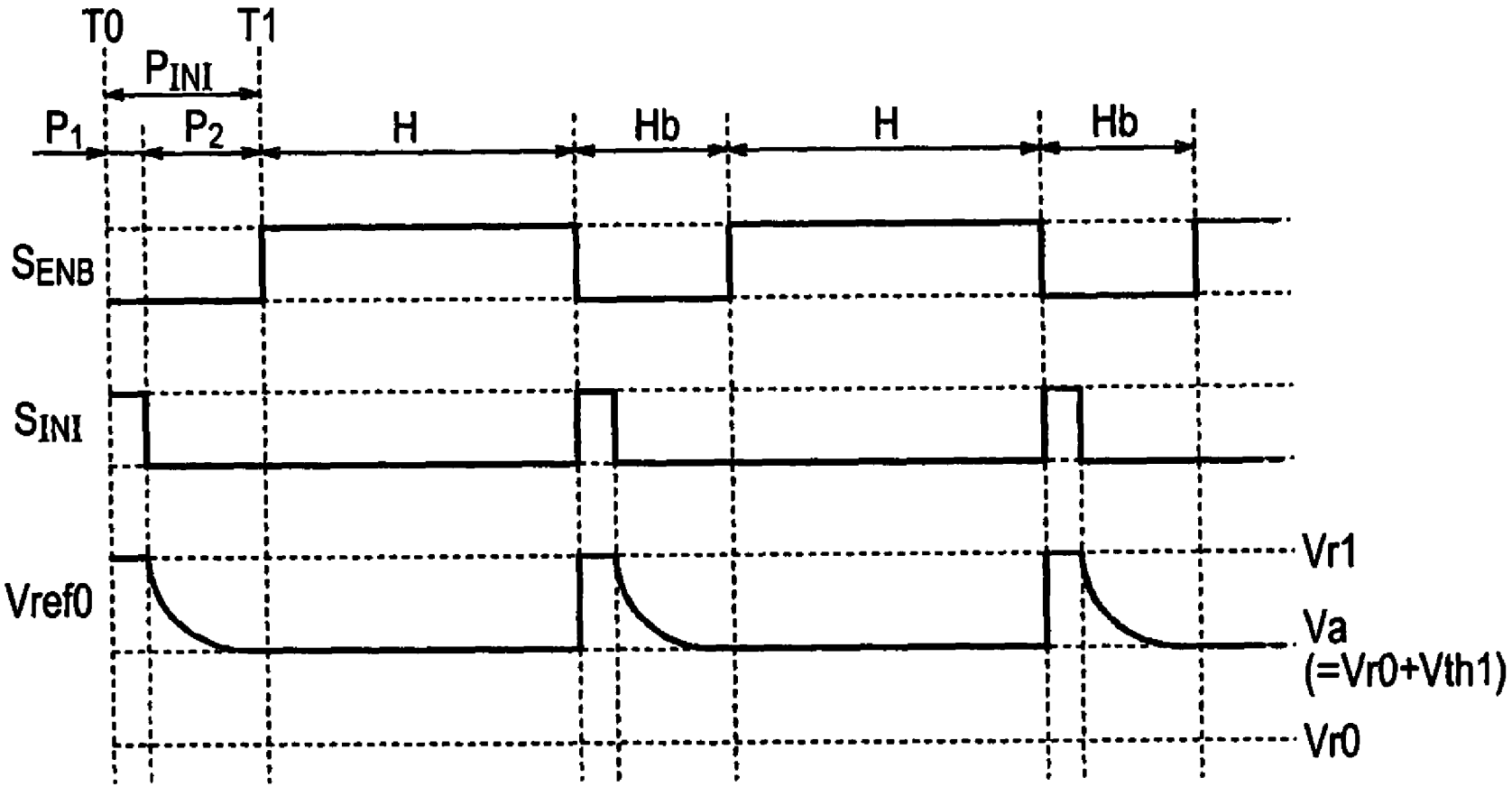
FIG. 4 is a timing diagram illustrating operations of the data-line driving circuit.

FIG. 4 is a timing diagram illustrating operations of the data-line driving circuit 20. As shown in the figure, the enable signal SENB keeps a low level in a predetermined period of time (hereinafter, referred to as "initialization period") PINI in which the time T0 when the electro-optical device 1 is powered on is the start time. When the end time T1 of the initialization period PINI has passed, the enable signal SENB keeps a high level in a horizontal scanning period when any one scanning line 101 is selected and keeps in a period of time (hereinafter, referred to as "blanking period") Hb from the end time of a horizontal scanning period H to the start time of the next horizontal scanning period H. The switching element 105 is turned on in the respective horizontal scanning periods H when the enable signal SENB keeps the high level and permits the output of the data signal Xj. On the other hand, the switching element is turned off in the initialization period PINI and the respective blanking periods Hb when the enable signal SENB keeps the low level and inhibits the output of the data signal Xj.

In the above-described configuration, the transistor Te corresponding to the gray-scale data D among the four transistors Te1 to Te4 is selectively turned on. Therefore, in the horizontal scanning periods H when the switching element 105 is turned on, current I (one or more current selected among I1 to I4) flows in one or more transistors Tf connected to the turned-on the transistor Te and a signal obtained by adding the current is supplied as the data signal Xj to the data line 103.

The reference voltage generating circuit 21 shown in FIG. 3 is a circuit for generating a voltage (hereinafter, referred to as "reference voltage") Vref1 which serves as a reference of the current value of the data signal Xj and includes a compensation circuit 211, a current generating transistor Tb, and a conversion circuit 213. Among these, the current generating transistor Tb is an n-channel type transistor in which current (hereinafter, referred to as "reference current") Ir0 corresponding to the voltage Vref0 of the gate terminal flows from the drain terminal to the source terminal. The source terminal of the current generating transistor Tb is connected to the ground line supplied with the ground potential Gnd.

The conversion circuit 213 is a circuit for generating the reference voltage Vref1 corresponding to the reference current Ir0 generated from the current generating transistor Tb and supplying the reference voltage to a reference voltage line 25 and includes a current mirror circuit 22 and a voltage generating transistor Td. Among these, the current mirror circuit 22 has p-channel type transistors Tc1 and Tc2 of which the gate terminals are connected to each other. The drain terminal of the transistor Tc1 is connected to the gate terminal thereof (that is, in a diode connection manner) and is connected to the drain terminal of the current generating transistor Tb. The source terminals of the transistors Tc1 and Tc2 are connected to the power supply line supplied with the power source potential Vdd. The power source potential Vdd is set to a level allowing the current generating transistor Tb, the transistors Tc1 and Tc2, and the voltage generating transistor Td to operate in a saturated region.

When the reference current Ir0 generated by the current generating transistor Tb flows in the transistor Tc1, the mirror current Ir1 corresponding to (typically equal to) the reference current is supplied to the voltage generating transistor Td through the transistor Tc2 from the power supply line. The voltage generating transistor Td is an n-channel type transistor of which the source terminal is connected to the ground line and of which the drain terminal and the gate terminal are connected in common to the reference voltage line 25. The voltage of the gate terminal of the voltage generating transistor Td becomes the reference voltage Vref1 corresponding to the mirror current Ir1. That is, the voltage generating transistor Td serves to supply the reference voltage Vref1 corresponding to the mirror current Ir1 (therefore, corresponding to the reference current Ir0) to the reference voltage line 25.

When the characteristic (specifically, threshold voltage) of the current generating transistor is different from a predetermined characteristic due to some reasons in manufacture, it is not possible to generate the reference current Ir0 (in addition, the reference voltage Vref1 having a predetermined voltage value) having a predetermined current value. As a result, errors can occur in the current value of the data signal Xj. The compensation circuit 211 shown in FIG. 3 is a circuit for compensating for the deviation in characteristic of the current generating transistor Tb. As shown in the figure, the compensation circuit 211 includes a compensation transistor Ta, a switching element SW, and a capacitor C1.

The compensation transistor Ta is an n-channel type transistor of which the drain terminal and the gate terminal are connected to the gate terminal of the current generating transistor Tb. The source terminal of the compensation transistor Ta is connected to a terminal 201. The terminal 201 is supplied with the voltage Vr0 from the power supply circuit not shown. On the other hand, the capacitor C1 is a capacitor interposed between the gate terminal of the current generating transistor Tb and the ground line and serves to hold the voltage of the gate terminal of the compensation transistor Ta.

The switching element SW serves to control the electrical connection and disconnection between the gate terminal of the compensation transistor Ta and the voltage supply line 27. The voltage supply line 27 is supplied with a voltage (hereinafter, referred to as "ON voltage") Vr1 generated by the power supply circuit not shown. The ON voltage Vr1 is set to a level for turning on the compensation transistor Ta. That is, the ON voltage Vr1 is set to a level higher than the voltage Va (=Vr0+Vth1) obtained by the threshold voltage Vth1 of the compensation transistor Ta to the voltage Vr0 supplied to the terminal 201.

The switching of the switching element SW is controlled by a control signal SINI supplied from the control circuit 30. As shown in FIG. 4, the control signal SINI keeps a high level in a period (hereinafter, referred to as "first period") P1 until a predetermined period of time (a period of time shorter than the initialization period PINI) passes from the start time T0 of the initialization period PINI and in a period until a predetermined period of time passes from the start time of the respective blanking periods Hb and keeps a low level in the other periods. The switching element SW is turned on in the first period P1 and the blanking periods Hb when the control signal SINI has the high level and is turned off in the other periods.

A-2. Operations of First Embodiment

Next, operations of the reference voltage generating circuit 21 will be described. First, in a first period P1, when the control signal SINI becomes a high level and the switching element SW is changed to the ON state, the gate terminal of the compensation transistor Ta is supplied with the ON voltage Vr1 of the voltage supply line 27. Since the ON voltage Vr1 is set to have a higher level than the voltage Va, the compensation transistor Ta is turned on in the first period P1. In addition, in the first period P1, the capacitor C1 is charged with the voltage Vr1.

Next, when the first period P1 passes and the control signal SINI is changed to a low level, the switching element SW is turned off and thus the supply of the ON voltage Vr1 to the gate terminal of the compensation transistor Ta is stopped. In a second period P2 successive to the first period P1, the charges accumulated in the capacitor C1 with the ON voltage Vr1 are discharged through the compensation transistor Ta with the lapse of time. With the discharge, the voltage Vref0 of the gate terminal of the compensation transistor Ta is gradually lowered from the ON voltage Vr1. Then, the compensation transistor Ta is changed to the OFF state at the time when the voltage Vref0 is lowered to the voltage Va (=Vr0+Vth1) and then the voltage Vref0 is kept at the voltage Va. In this way, the end time T1 of the initialization period PINI comes after the level of the voltage Vref0 is stabilized. That is, the second period P2 is set to have a period of time greater than the period of time required for lowering the voltage Vref0 of the capacitor C1 to the voltage Va from the voltage Vr1. Hereinafter, the operation of supplying the ON voltage Vr1 to the compensation transistor Ta (that is, an operation of turning on the switching element SW) is referred to as a "refresh operation."

In this way, the voltage Vref0 in the initialization period PINI is set to the voltage Va, but after the setting, the voltage Vref0 may be changed due to noises generated in the gate terminal of the compensation transistor Ta. For example, when the voltage Vref0 of the gate terminal of the compensation transistor Ta is lower than the voltage Va due to the noises, the voltage Vref0 is kept at the voltage after the lowering. Accompanying this, when the reference voltage Vref1 is lowered, the current value of the data signal Xj is smaller than that of the normal state where the voltage Vref0 is kept at the voltage Va, thereby deteriorating the contrast of images. When the voltage Vref0 of the gate terminal of the compensation transistor Ta becomes higher than the voltage Va due to the noises, the compensation transistor Ta is changed to the ON state and thus the voltage Vref0 is lowered again to the voltage Va. Accordingly, the images are little affected by the noises. That is, in the configuration shown in FIG. 3, specifically the noise lower than the voltage Va (hereinafter, referred to as "negative-polarity noise") causes a problem. In order to prevent the deterioration in display quality due to the negative-polarity noise, in the present embodiment, the refresh operation is regularly performed by turning on the switching element SW in response to the control signal SINI, even in the respective blanking periods Hb after the initialization period PINI has passed.

That is, when the control signal SINI is changed to the high level in the blanking period Hb, the ON voltage Vr1 is supplied to the compensation transistor Ta and the capacitor C1 is charged with the ON voltage Vr1, similarly to the first period P1. When the control signal SINI is changed to the low level from the high level, the voltage Vref0 is lowered from the ON voltage Vr1 to the voltage Va and is stabilized due to the discharge of the capacitor C1. In order to prevent the data signal Xj from being output while the voltage Vref0 (in addition, the voltage Vref1) is being changed, the blanking period Hb is set to a period of time longer than the sum of the period of time when the control signal SINI keeps the high level and the period of time when the voltage Vref0 is lowered to the voltage Va.

When the voltage Vref0 stabilized after the refresh operation is supplied to the gate terminal, the reference current Ir0 corresponding to the voltage Vref0 flows in the current generating transistor Tb and in addition, the mirror current Ir1 corresponding to the reference current Ir0 flows in the voltage generating transistor Td. Therefore, the reference voltage Vref1 corresponding to the Vref0 is supplied to the reference voltage line 25. Since the enable signal SENB keeps the high level in the horizontal scanning periods H after the initialization period PINI has passed, the data signals X1 to Xn generated from the current output circuits 23 on the basis of the reference voltage Vref1 are output to the data lines 103 through the switching elements 105.

Here, the reference current Ir0 flowing in the current generating transistor Tb is expressed by Expression 1.

$$Ir0=(1/2)\beta(Vref0-Vth2)^2 \quad (1)$$

Here, β is a gain coefficient of the current generating transistor Tb and Vth2 is a threshold voltage of the current generating transistor.

As described above, since the Vref0 is stabilized to the voltage Va obtained by adding the voltage Vth1 to the voltage Vr0 after the initialization period PINI has passed (Vref0=Va=Vr0+Vth1), Expression 1 can be expressed by Expression 2.

$$Ir0=(1/2)\beta(Vr0+Vth1-Vth2)^2 \quad (2)$$

Here, since the current generating transistor Tb and the compensating transistor are disposed close to each other, the respective characteristics are approximately equal to each other. That is, it can be considered that the threshold voltage Vth1 and the threshold voltage Vth2 are approximately equal to each other. Accordingly, Expression 2 is modified to Expression 3:

$$Ir0=(1/2)\beta(Vr0)^2 \quad (3)$$

As can be apparently seen from Expression 3, the reference current Ir0 does not rely on the threshold voltage Vth2 of the current generating transistor Tb. Accordingly, the reference voltage Vref1 generated on the basis of the reference current Ir0 is the voltage obtained by compensating for the deviation in threshold voltage Vth2 of the current generating transistors Tb (that is, the voltage not relying on the threshold voltage Vth2). In addition, the reference voltage Vref1 is appropriately adjusted by changing the voltage Vr0 supplied to the terminal 201. Since the maximum value of the current value of the data signal Xj is determined in accordance with the reference voltage Vref1, it is possible to arbitrarily adjust the contrast of images displayed in the pixel area P, by changing the voltage Vr0.

As described above, in the first embodiment, since the refresh operation is performed plural times in the initialization period PINI and the blanking periods Hb. Accordingly, even when the voltage Vref0 of the gate terminal of the compensation transistor Ta is lowered from the voltage Va due to the negative-polarity noise, the voltage is returned to the voltage Va in the successive blanking period Hb. Therefore, the influence of the negative-polarity noise can be reduced, thereby maintaining excellent display quality. Although the configuration that the refresh operation is performed in the blanking period Hb between the successive horizontal scanning periods has been exemplified in the first embodiment, a configuration that the refresh operation is performed in a blanking period between the successive vertical scanning periods may be employed, instead of such a configuration or together with such a configuration.

The voltage Vref0 serving as a basis of the reference voltage Vref1 is generated by lowering the ON voltage Vr1 to the voltage Va. As a result, when the data signal Xj is output in the course of lowering the voltage Vref0, it is not possible to set the data signal Xj to a predetermined current value. In the first embodiment, since the output of the data signal Xj is started in the state where the initialization period PINI or the blanking period Hb has passed to stabilize the voltage Vref0, there is an advantage that the data signal Xj having the current value corresponding to the gray-scale data D can be generated with high accuracy.

A-3. Modified Example of First Embodiment

The first embodiment can be modified in various forms. The specific modified examples are described as follows. The following modified examples may be properly combined.

A-3-1. First Modified Example

In the first embodiment, the configuration that one reference voltage generating circuit 21 is provided in one current output circuit 23 has been described. On the contrary, in the first modified example, one reference voltage generating circuit 21 is shared by a plurality of current output circuits 23.

Figure 5:
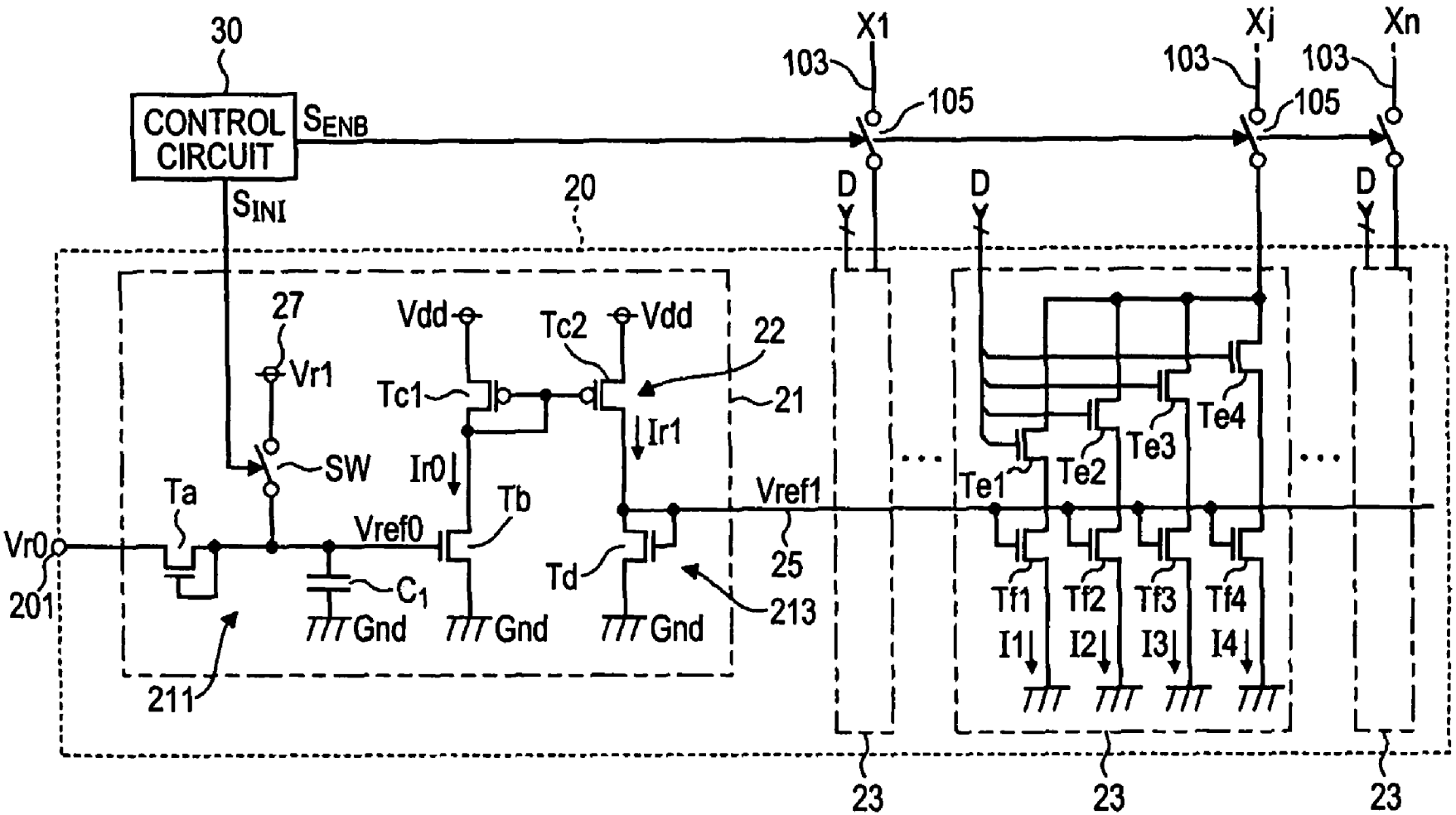
FIG. 5 is a circuit diagram illustrating a configuration of the data-line driving circuit according to a first modified example.

FIG. 5 is a block diagram illustrating a configuration of the data-line driving circuit 20 of the electro-optical device 1 according to the first modified example. As shown in the figure, the data-line driving circuit 20 according to the first modified example includes one reference voltage generating circuit 21 and n current output circuits 23 corresponding to the total number of the data lines 103. In FIG. 5, only the configuration of the current output circuit 23 corresponding to the j-th data line 103 is specifically shown, but the other current output circuits 23 have the same configuration. As shown in FIG. 5, the gate terminals of the transistors Tf1 to Tf4 in all the current output circuits 23 included in the data-line driving circuit 20 are connected in common to the reference voltage line 25.

As described above, in the first modified example, since one reference voltage generating circuit 21 is shared by a plurality of current output circuits 23, it is possible to reduce the circuit size of the data-line driving circuit 20, in comparison with the configuration of FIG. 3 in which the reference voltage generating circuit 21 is disposed in each current output circuit 23.

Since the current generating transistor Tb and the conversion circuit 213 are interposed between the compensation circuit 211 and the reference voltage line 25, it is possible to stabilize the reference voltage Vref1 at a predetermined level with high accuracy. This advantage is specifically described as follows.

As the configuration that a plurality of current output circuits 23 share one reference voltage generating circuit 21, a configuration that the voltage Vref0 generated by the compensation circuit 211 is supplied to the reference voltage line 25 and is supplied to the respective current output circuits 23 without providing the current generating transistor Tb or the conversion circuit 213 (that is, a configuration that the gate terminal of the compensation transistor Ta is connected to the reference voltage line 25) can be considered. In such a configuration (hereinafter, referred to as "alternative configuration"), the transistors Tf1 to Tf4 of all the current output circuits 23 are connected in common to the gate terminal of the compensation transistor Ta. Here, when leakage of current occurs between the gate terminal and the source terminal of the transistors Tf, the voltage Vref0 of the compensation transistor Ta is lowered from a predetermined level. In the alternative configuration, since a plurality of transistors Tf are connected directly to the gate terminal of the compensation transistor Ta, the possibility that the leakage of current occurs in the transistors Tf to lower the voltage Vref0 is high.

On the contrary, in the first modified example, since one current generating transistor Tb is connected to the gate terminal of the compensation transistor Ta, the reference voltage Vref1 corresponding to the voltage Vref0 is generated from the current generating transistor Tb and the conversion circuit 213 and then is supplied to the gate terminals of the transistors Tf1 to Tf4 in the current output circuits 23. Accordingly, even when the leakage of current occurs from the transistors Tf of any one current output circuit 23, the reference voltage Vref1 can be kept at a predetermined level. As a result, it is possible to control the current value of the data signal Xj with high accuracy. This advantage is specifically advantageous for the configuration of the first modified example that a plurality of transistors Tf are connected to one reference voltage generating circuit 21.

Figure 6:
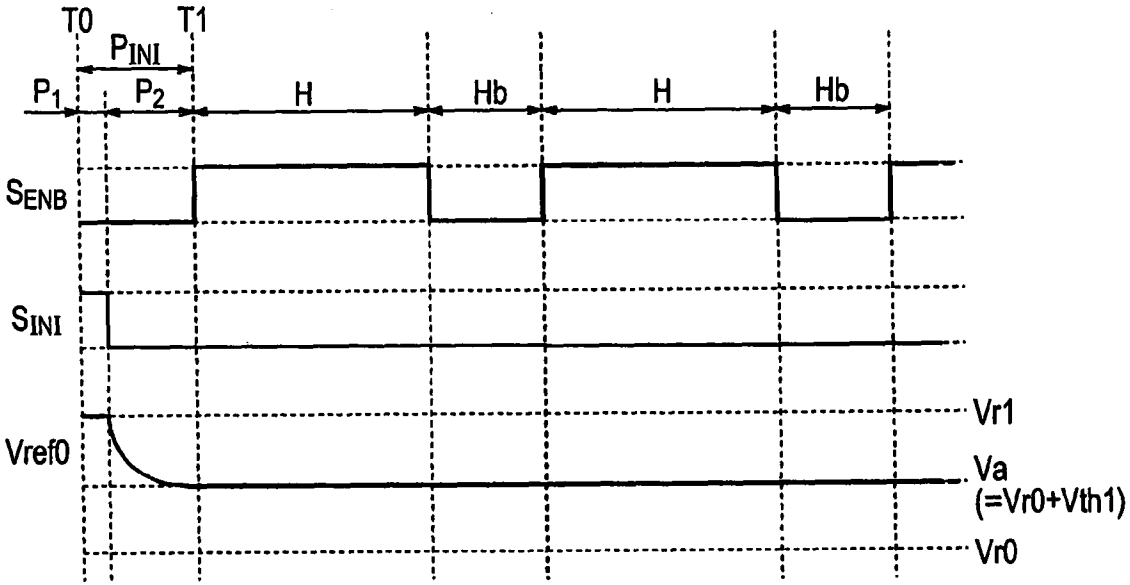
FIG. 6 is a timing diagram illustrating operations of the data-line driving circuit according to the first modified example.

In the configuration shown in FIG. 5, similarly to the first embodiment, the refresh operation is performed plural times in the initialization period PINI and the blanking periods Hb. However, in the first modified example, as exemplified in FIG. 6, a configuration that the refresh operation is performed only in the initialization period PINI (a configuration that the refresh operation is not performed in the blanking periods Hb) may be employed.

A-3-2. Second Modified Example

In the examples described above, the configuration that the refresh operation is performed regularly has been exemplified. On the contrary, in the second modified example, the refresh operation is performed only when the voltage Vref0 is lower than the voltage Va.

Figure 7:
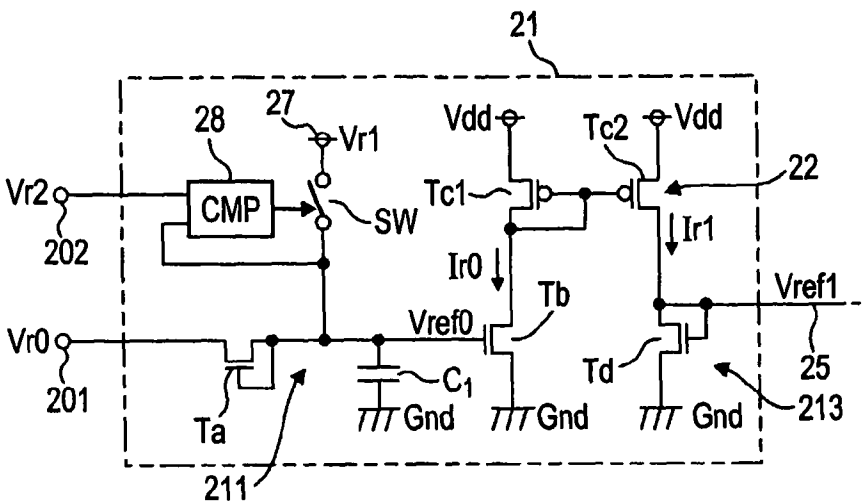
FIG. 7 is a circuit diagram illustrating a configuration of a reference voltage generating circuit according to a second modified example.

FIG. 7 is a circuit diagram illustrating a configuration of the reference voltage generating circuit 21 disposed in each unit circuit U according to the second modified example. As shown in the figure, the reference voltage generating circuit 21 according to the second modified example includes a comparison circuit (CMP) 28. The comparison circuit 28 is a circuit for comparing the voltage Vref0 of the gate terminal of the compensation transistor Ta with the voltage Vr2 supplied to the terminal 202 and controlling the switching of the switching element SW in accordance with the comparison result. More specifically, the comparison circuit 28 turns on the switching element SW to perform the refresh operation when the voltage Vref0 is lower than the voltage Vr2 and keeps the switching element SW in the OFF state when the voltage Vref0 is higher than the voltage Vr2. The voltage Vr2 is set to a level between the voltage Vr0 and the voltage Va (Vr0<Vr2<Va=Vr0+Vth1).

In this configuration, when the negative-polarity noise does not occur (when the noise does not occur at all and when the voltage Vref increases due to the noise), the voltage Vref0 is higher than the voltage Vr2. Accordingly, the switching element SW is kept in the OFF state. Therefore, in this case, the refresh operation is not performed. On the contrary, when the negative-polarity noise occurs and the voltage Vref0 is lower than the voltage Vr2, the switching element SW is turned on by the comparison circuit 28. Then, the ON voltage Vr1 is supplied to the gate terminal of the compensation transistor Ta, thereby performing the refresh operation.

In this way, in the present modified example, since the refresh operation is performed only when the voltage Vref is lowered, it is possible to further suppress the power consumption, in comparison with the configuration of the first embodiment in which the refresh operation is performed regularly regardless of existence of noises.

A-3-3. Third Modified Example

Next, a third modified example will be described. In the data-line driving circuit 20 according to the third modified example, the refresh operation is performed regularly after the initialization period PINI has passed, as well as in the initialization period PINI.

Figure 8:
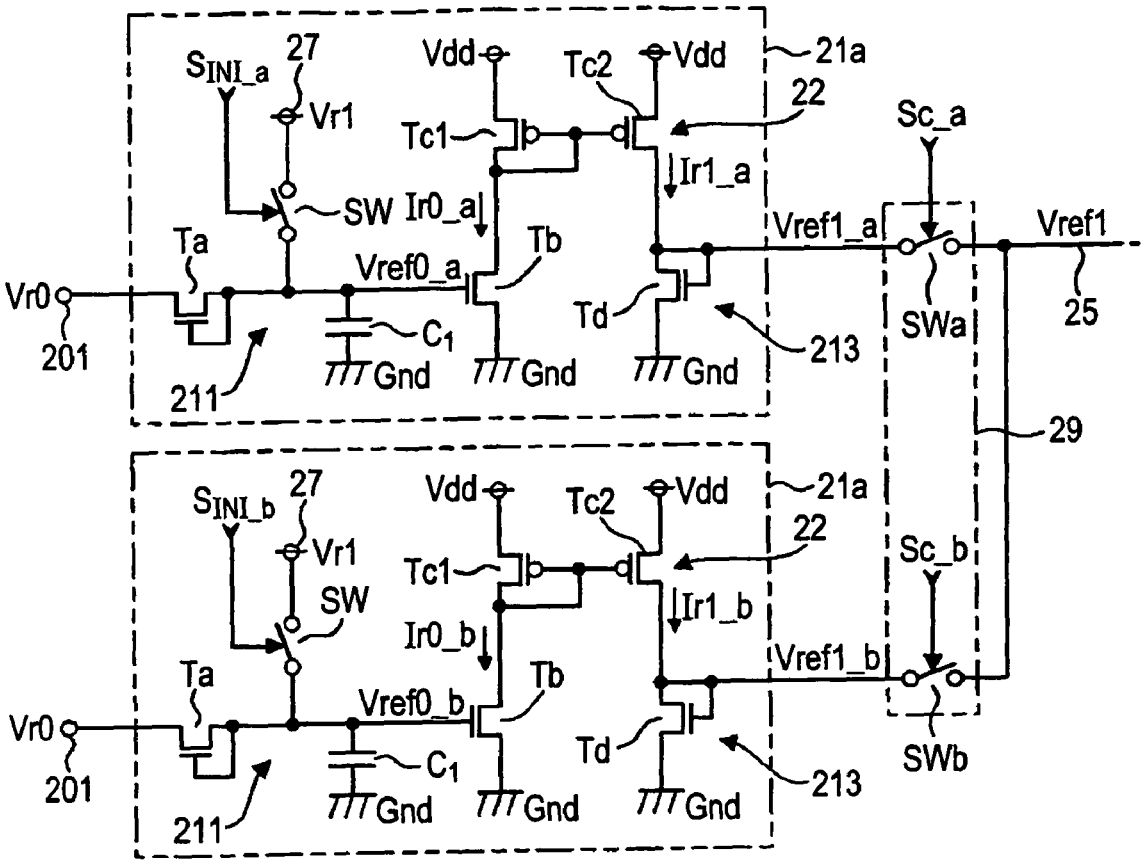
FIG. 8 is a circuit diagram illustrating a configuration of a previous stage of a current output circuit according to a third modified example.

FIG. 8 is a circuit diagram illustrating a configuration of the front stage of the current output circuit 23 in the unit circuit U. As shown in FIG. 8, in the third modified example, one unit circuit U has two reference voltage generating circuits 21*a* and 21*b*. The reference voltage generating circuit 21*a* and 21*b* have the same configuration as the reference voltage generating circuit 21 according to the first embodiment. That is, the reference voltage generating circuit 21*a* outputs a reference voltage Vref1_a on the basis of reference current Ir0_a generated by the current generating transistor Tb in accordance with a voltage Vref0_a of the gate terminal of the compensation transistor Ta and the reference voltage generating circuit 21*b* outputs a reference voltage Vref1_b on the basis of reference current Ir0_b corresponding to a voltage Vref0_b.

Figure 9:
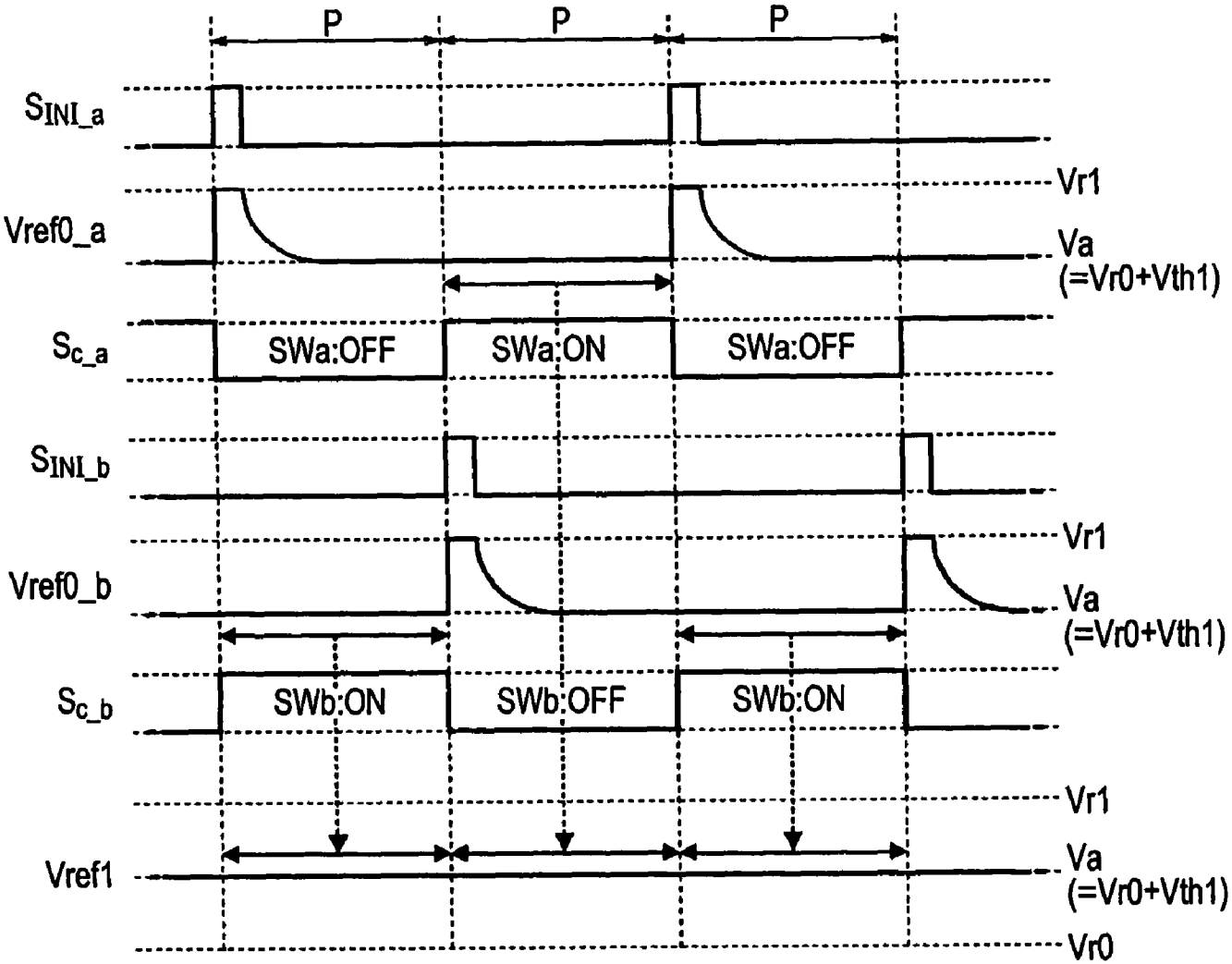
FIG. 9 is a timing diagram illustrating operations in the third modified example.

The switching of a switching element SW of the reference voltage generating circuit 21*a* is controlled by a control signal SINI_a and the switching of a switching element SW of the reference voltage generating circuit 21*b* is controlled by a control signal SINI_b. FIG. 9 is a timing diagram illustrating operations of the data-line driving circuit 20 according to the present modified example. After the initialization period PINI has passed, the control signals SINI_a and SINI_b are alternately changed to a high level every predetermined period P as shown in FIG. 9. Accordingly, the refresh operation is alternately performed every period P by the reference voltage generating circuits 21*a* and 21*b*. That is, when the reference voltage generating circuit 21*a* performs the refresh operation in a period P, the reference voltage generating circuit 21*b* performs the refresh operation in the next period P, and the reference voltage generating circuit 21*a* performs the refresh operation in the next period P.

As shown in FIG. 8, a selection circuit 29 is disposed at the rear stage of the reference voltage generating circuits 21*a* and 21*b*. The selection circuit 29 is a circuit selecting any one of the reference voltage Vref_a generated from the reference voltage generating circuit 21 and the reference voltage Vref_b generated from the reference voltage generating circuit 21*b* and supplying the selected reference voltage to the reference voltage line 25. The selection circuit has a switching element SWa disposed at the rear stage of the reference voltage generating circuit 21*a* and a switching element SWb disposed at the rear stage of the reference voltage generating circuit 21*b*. The switching element SWa is disposed between the gate terminal of the voltage generating transistor Td of the reference voltage generating circuit 21*a* and the reference voltage line 25 and the switching thereof is controlled by a selection signal Sc_a supplied from the control circuit 30. On the other hand, the switching element SWb is disposed between the gate terminal of the voltage generating transistor Td of the reference voltage generating circuit 21*b* and the reference voltage line 25 and the switching thereof is controlled by a selection signal Sc_b supplied from the control circuit 30.

As shown in FIG. 9, the selection signals Sc_a and Sc_b are alternately changed to a high level every period P. More specifically, the selection signal Sc_a has a high level from the start time to the end time of the period P right successive to the period P when the control signal SINI_a has a high level. Similarly, the selection signal Sc_b has a high level from the start time to the end time of the period P right successive to the period P when the control signal SINI_b has a high level. In other words, the selection signal Sc_a has a high level in the period P when the control signal SINI_b has a high level and the selection signal Sc_b has a high level in the period P when the control signal SINI_a has a high level.

In this configuration, when one of the reference voltage generating circuits 21*a* and 21*b* performs the refresh operation, the other supplies the reference voltage Vref1 to the reference voltage line 25. For example, in the period P when the control signal SINI_a has a high level and the reference voltage generating circuit 21*a* performs the refresh operation, the selection signal SINI_b is changed to a high level and the switching element SWb is turned on. Accordingly, the reference voltage Vref_b generated from the reference voltage generating circuit 21*b* is supplied as the reference voltage Vref1 to the reference voltage line 25. In the period P when the control signal SINI_b has a high level, the switching element SWa is turned on by the selection signal SINI_a and thus the reference voltage Vref_a is output to the reference voltage line 25.

In this way, since the reference voltage generating circuits 21*a* and 21*b* operate complementarily in the present modified example, the constant reference voltage Vref1 can always be supplied to the respective current output circuits 23 regardless of the variation of the voltage Vref0 accompanied with the refresh operation. Accordingly, the period when the output of the data signal Xj is inhibited (that is, the period when the switching element 105 is turned off) or the switching element 105 for inhibiting the output of the data signal may not be necessary.

However, in the configuration according to the present modified example, noises may occur in the reference voltage line 25 to change the reference voltage Vref1 at the time when the supply source of the reference voltage Vref1 is switched from one of the reference voltage generating circuits 21*a* and 21*b* to the other. Therefore, the supply source of the reference voltage Vref1 may be switched in the blanking period Hb (that is, the levels of the selection signals Sc_a and Sc_b are varied) and the switching element 105 may be turned off in the blanking period Hb, similarly to the first embodiment. Since the length of the period when the noise can occur due to the switching of the supply source of the reference voltage Vref1 is sufficiently smaller than the length of the period when the voltage Vref0 is changed from the ON voltage Vr1 to the voltage Va accompanied with the refresh operation, the configuration has an advantage that the blanking period Hb can be reduced.

Although the unit circuit U having two reference voltage generating circuits 21*a* and 21*b* has been exemplified in FIG. 8, one unit circuit U may have three or more reference voltage generating circuits 21. In this configuration, the respective reference voltage generating circuits 21 sequentially perform the refresh operation every period P and the selection circuit 29 selects the reference voltage generated from the reference voltage generating circuit 21 having performed the refresh operation in the period P, in the successive period P.

A-3-4. Fourth Modified Example

Figure 10:
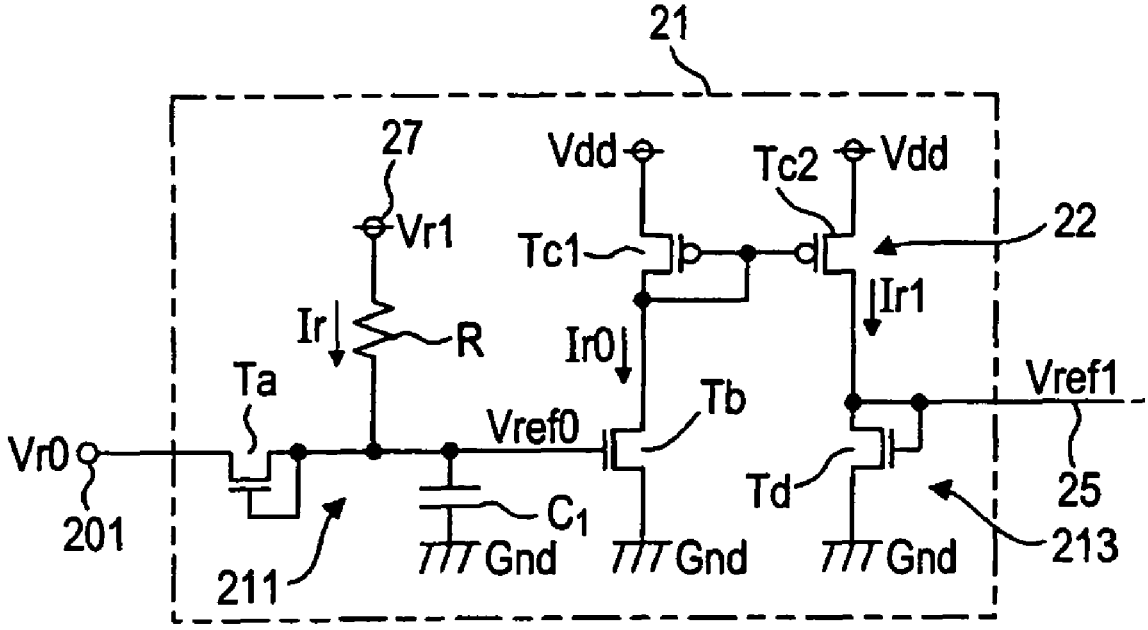
FIG. 10 is a circuit diagram illustrating a configuration of a reference voltage generating circuit according to a fourth modified example.

FIG. 10 is a circuit diagram illustrating a configuration of a reference voltage generating circuit provided in the unit circuit U according to the fourth modified example. As shown in the figure, the reference voltage generating circuit 21 has a resistor R instead of the switching element SW in the first embodiment. That is, the voltage supply line 27 supplied with the ON voltage Vr1 and the gate terminal of the compensation transistor Ta are electrically connected to each other through the resistor R. The resistor R has such a high resistance value that micro current Ir flow in the resistor R. The current Ir is current flowing in the compensation transistor Ta when the voltage Vref0 has a level close to the voltage Va or current slightly greater than the current.

According to this configuration, since the micro current Ir is always supplied to the compensation transistor Ta through the resistor R from the voltage supply line 27, it is possible to maintain the voltage Vref0 of the gate terminal of the current generating transistor Tb as the voltage Va without performing the refresh operation shown in the first embodiment or the first to third modified examples. Accordingly, the configuration of the reference voltage generating circuit 21 or the configuration for controlling the operation thereof (for example, the control circuit 30) can be simplified. In addition, in the configuration, since the voltage of the gate terminal of the compensation transistor Ta is kept approximately constant by the resistor R, the capacitor C1 holding the voltage can be properly omitted.

A-3-5. Other Modified Examples

The first embodiment or the first to fourth modified examples can be modified as follows.

In the above-described embodiment, the configuration that the current generating transistor Tb and the conversion circuit 213 are interposed between the compensation circuit 211 and the reference voltage line 25 has been exemplified. However, a configuration that the current generating transistor Tb and the conversion circuit 213 are omitted, that is, a configuration that the voltage Vref0 generated by the compensation circuit 211 is supplied to the reference voltage line 25 and is thus supplied to the current output circuit 23 (that is, a configuration that the gate terminal of the compensation transistor Ta is connected to the reference voltage line 25), may be employed. According to this configuration, it is possible to simplify the configuration of the unit circuit U. Above all, according to the configuration the reference voltage generating circuit 21 includes the current generating transistor Tb and the conversion circuit 213 similarly to the first embodiment, it is possible to stabilize the reference voltage Vref1 at a predetermined level with higher accuracy in comparison with the present modified example. This advantage is specifically described as follows.

In the configuration according to the present modified example, all the transistors Tf1 to Tf4 of the current output circuit 23 are connected in common to the gate terminal of the compensation transistor Ta. Here, when leakage of current occurs between the gate terminal and the source terminal of the respective transistors Tf, the voltage Vref0 of the compensation transistor Ta is lowered from the predetermined level. In the configuration of the present modified example, since the gate terminal of the compensation transistor Ta is connected directly to a plurality of transistors Tf, there is a problem in that the possibility that the leakage of current occurs in the transistors Tf and the voltage Vref0 is lowered is high. In order to embody multi gray scales of an image, it is necessary to increase the number of levels in the current value of the data signal Xj. However, since the number of transistors Tf need increase for the purpose, such a problem becomes further remarkable.

On the other hand, in the first embodiment, since the gate terminal of the compensation transistor Ta is connected to one current generating transistor Tb, the reference voltage Vref1 corresponding to the voltage Vref0 is generated by the use of the current generating transistor Tb and the conversion circuit 213 and then is supplied to the gate terminals of the transistors Tf1 to Tf4. Accordingly, even if the leakage of current occurs in any one transistor Tf of the current output circuit 23, it is possible to keep the reference voltage Vref1 at a predetermined level and as a result, to control the current value of the data signal Xj with high accuracy.

(2) In the above-described examples, the configuration that the capacitor C1 is connected to the gate terminal of the current generating transistor Tb has been exemplified. However, the capacitor C1 is not necessary. For example, only the same operation can be obtained by the use of a gate capacitance of the compensation transistor Ta or the current generating transistor Tb, it is not necessary to dispose the capacitor C1 independently of other elements.

(3) In the above-described example, the configuration that the compensation transistor Ta and the current generating transistor Tb have the same characteristic has been exemplified. However, the characteristic need not be accurately equal to each other. For example, as long as an image displayed by the electro-optical device is not affected visually, the threshold voltage Vth1 of the compensation transistor Ta and the threshold voltage Vth2 of the current generating transistor may be difference from each other.

(4) The conduction types of the transistors constituting the reference voltage generating circuit 21 can be appropriately changed. For example, a configuration that the n-channel type transistors Ta, Tb, and Td in the reference voltage generating circuit 21 are replaced with p-channel type transistors and the p-channel type transistors Tc1 and Tc2 are replaced with n-channel type transistors may be employed. However, in this configuration, for example, it is necessary to replace the power source potential Vdd shown in FIG. 1 with the ground potential Gnd and to replace the ground potential Gnd with the power source potential Vdd.

(5) The configuration of the pixel circuit 40 can be arbitrarily changed. Accordingly, the type of the data signal Xj is properly changed in accordance with the configuration of the pixel circuit 40. For example, although the electro-optical device 1 in which the data signal Xj having the current value corresponding to the gray-scale data D is output has been exemplified in the above-described examples, the invention may apply to an electro-optical device of a pulse width modulation type in which the data signal Xj having a first current value and a second current value with a time density corresponding to the gray-scale data D is output. In addition, the invention may apply to any electro-optical device of a dot-sequential driving method in which the data signal Xj is sequentially output every column and a line-sequential driving method in which the data signals X1 to Xn corresponding to the entire columns are simultaneously output.

B. Second Embodiment

Next, a second embodiment of the invention will be described. In the second embodiment, the elements similar to those of the first embodiment are denoted by the same reference numerals and description thereof is appropriately omitted.

B-1. Configuration of Data-line Driving Circuit

Figure 11:
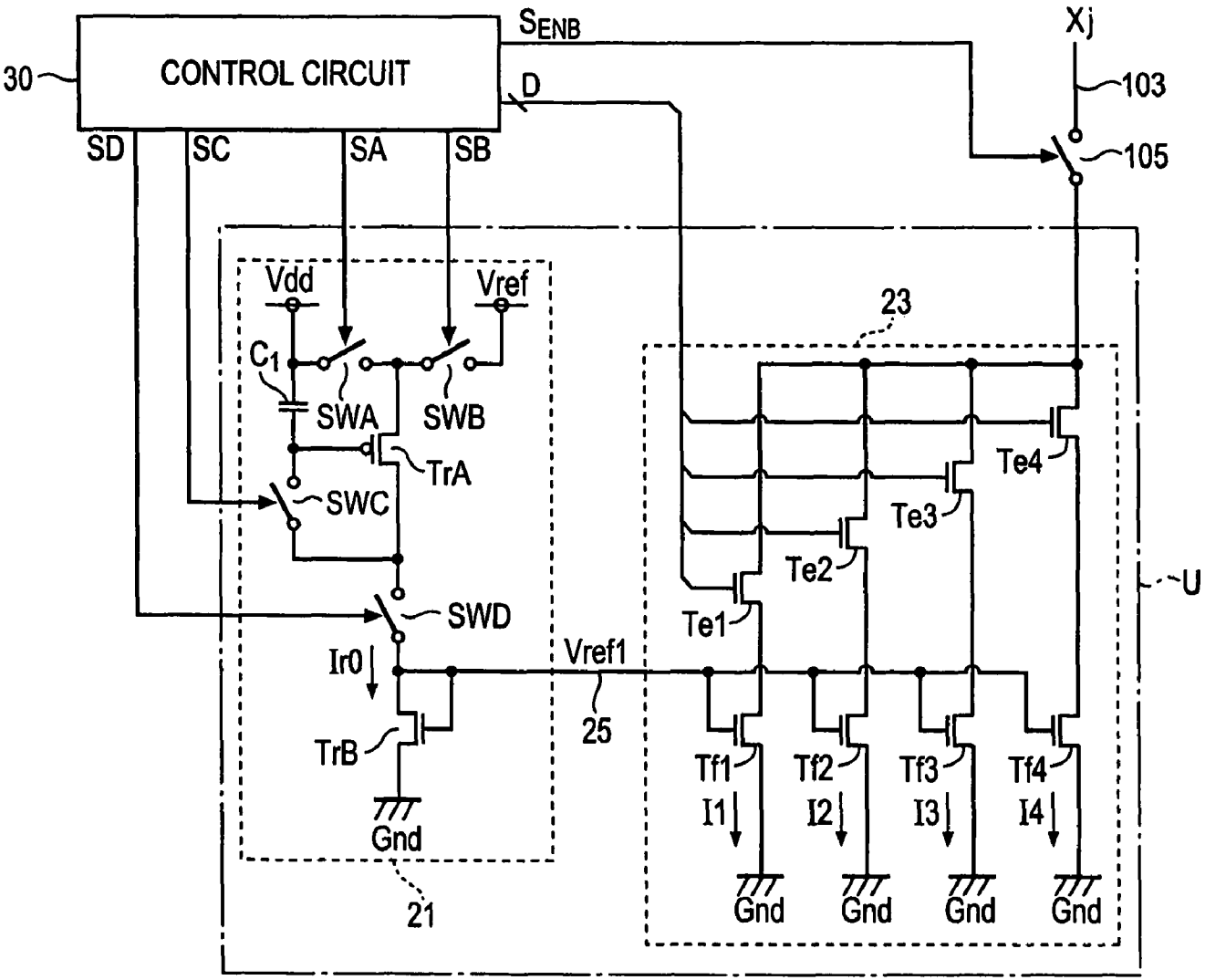
FIG. 11 is a circuit diagram illustrating a configuration of a unit circuit in a data-line driving circuit according to a second embodiment of the invention.

FIG. 11 is a circuit diagram illustrating a specific configuration of a unit circuit U included in the data-line driving circuit 20. In the figure, only the configuration of one unit circuit U in the j-th column is shown, but other unit circuits U have the same configuration. As shown in FIG. 11, each unit circuit U includes a reference voltage generating circuit 21 as a reference voltage generating unit and a current output circuit 23 as a current output unit, which are connected to each other through a reference voltage line 25. The configuration of each current output circuit 23 is similar to that of the first embodiment. The switching of all the switching elements 105 disposed at the rear stage of the respective unit circuits U is controlled in accordance with an enable signal SENB supplied in common from the control circuit 30.

Figure 12:
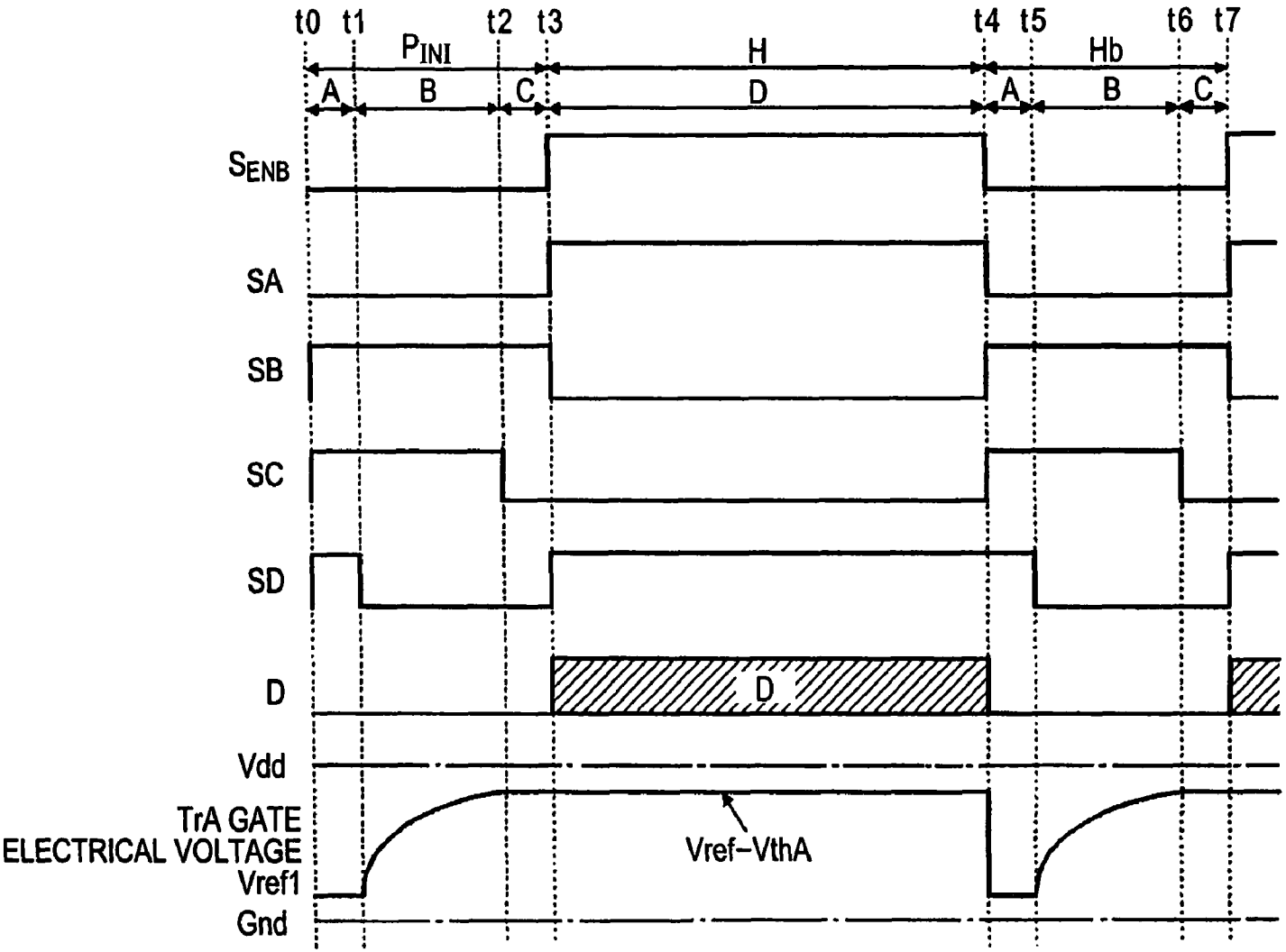
FIG. 12 is a timing diagram illustrating operations of the data-line driving circuit.

FIG. 12 is a timing diagram illustrating operations of the data-line driving circuit 20. As shown in the figure, the enable signal SENB keeps a low level in the initialization period PINI from the time t0 when the electro-optical device 1 is powered on to the time t3. When the end time t3 of the initialization period PINI has passed, the enable signal SENB keeps a high level in a horizontal scanning period H when any one scanning line is selected and keeps a low level in a blanking period Hb from the end time t4 of a horizontal scanning period H to the start time t7 of the next horizontal scanning period H.

Configuration of Reference Voltage Generating Circuit

The reference voltage generating circuit 21 shown in FIG. 11 is a circuit for generating the reference voltage Vref1 serving as a basis of the current value of the data signal Xj and includes a current generating transistor TrA for generating the reference current-Ir0 serving as a basis of the reference voltage Vref1, a capacitor C1 as a capacitor, a voltage generating transistor TrB for outputting the reference voltage Vref1, and four switching elements SWA, SWB, SWC, and SWD.

The reference voltage generating circuit 21 is supplied with a power source potential Vdd and a predetermined potential Vref set lower than the power source potential from the power supply circuit (not shown). For example, when the power source potential Vdd is 15V, the potential Vref is set to about 13V.

The capacitor C1, of which one terminal is connected to the power source potential Vdd and the other terminal is connected to the gate terminal of the current generating transistor TrA, serves to hold the voltage of the gate terminal of the current generating transistor TrA.

The voltage generating transistor TrB is an n-channel type transistor of which the source terminal is connected to the ground line supplied with the ground potential Gnd, the gate terminal is connected to the drain terminal thereof (in a diode connection manner), and the drain terminal is connected to the gate terminals of the transistors Tf (Tf1 to Tf4) in the current output circuit 23 through the reference voltage line 25.

The switching element SWA, of which one terminal is connected to the power source potential Vdd and the other terminal is connected to the source terminal of the current generating transistor TrA, is switched between a connection state (electrically connected state) and a disconnection state (electrically disconnected state) in accordance with the control signal SA from the control circuit 30. The switching element SWA in the second embodiment is switched to the connection state when the control signal SA has a high level and is switched to the disconnection state when the control signal has a low level.

The switching element SWB, of which one terminal is connected to the potential Vref and the other terminal is connected to the source terminal of the current generating transistor TrA, is switched between a connection state and a disconnection state in accordance with the control signal SB from the control circuit 30. The switching element SWB in the second embodiment is switched to the connection state when the control signal SB has a high level and is switched to the disconnection state when the control signal has a low level.

The switching element SWC, of which one terminal is connected to the gate terminal of the current generating transistor TrA and the other terminal is connected to the drain terminal of the current generating transistor TrA, is switched between a connection state and a disconnection state in accordance with the control signal SC from the control circuit 30. The switching element SWC in the second embodiment is switched to the connection state when the control signal SC has a high level and is switched to the disconnection state when the control signal has a low level.

The switching element SWD, of which one terminal is connected to the drain terminal of the current generating transistor TrA and the other terminal is connected to the drain terminal of the voltage generating transistor TrB, is switched between a connection state and a disconnection state in accordance with the control signal SD from the control circuit 30. The switching element SWD in the second embodiment is switched to the connection state when the control signal SD has a high level and is switched to the disconnection state when the control signal has a low level.

The current generating transistor TrA is a p-channel type transistor. When the control signal SA from the control circuit 30 has a high level and the control signal SB has a low level, the switching element SWA is switched to the connection state and the switching element SWB is switched to the disconnection state, thereby supplying the power source potential Vdd to the source terminal of the current generating transistor. When the control signal SA has a low level and the control signal SB has a high level, the switching element SWA is switched to the disconnection state and the switching element SWB is switched to the connection state, thereby supplying the voltage Vref to the source terminal of the current generating transistor. As shown in FIG. 12, the control signals SA and SB are inverted with respect to each other and are controlled such that thus the logical levels are not in common.

When the control signal SC from the control circuit 30 has a high level, the switching element SWA is switched to the connection state and the gate terminal and the drain terminal of the current generating transistor TrA are connected to each other (in a diode connection manner). When the control signal SD from the control circuit 30 has a high level, the switching element SWD is switched to the connection state and the drain terminal of the current generating transistor TrA and the drain terminal of the voltage generating transistor TrB are connected to each other.

B-2. Operations of Second Embodiment

Next, operations of the second embodiment will be described. In the second embodiment, since the operations other than that of the reference voltage generating circuit 21 are similar to those of the first embodiment, the operation of the reference voltage generating circuit 21 is mainly described now.

Figure 13:
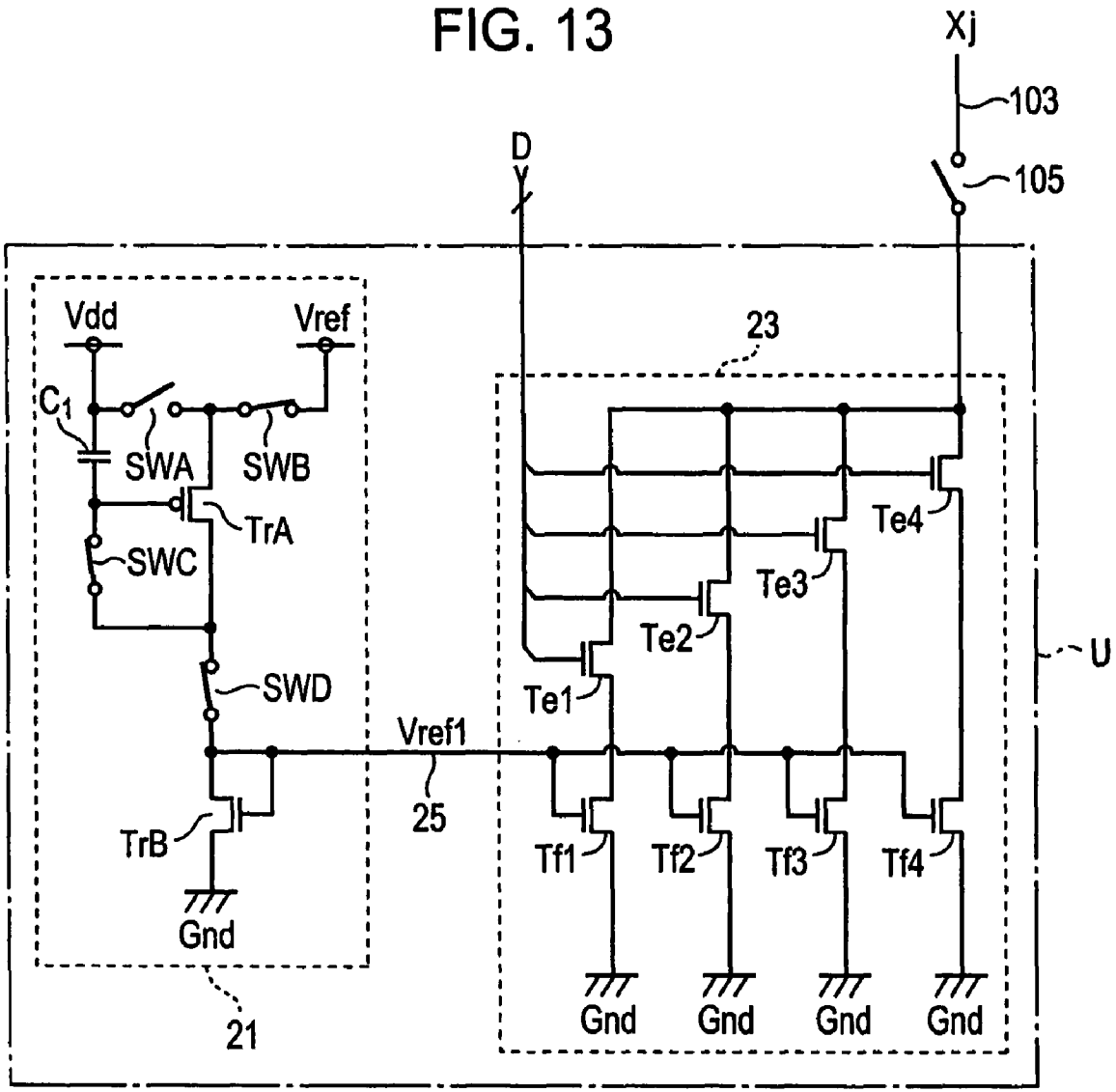
FIG. 13 is a circuit diagram illustrating a state of the unit circuit in a period A.
Figure 14:
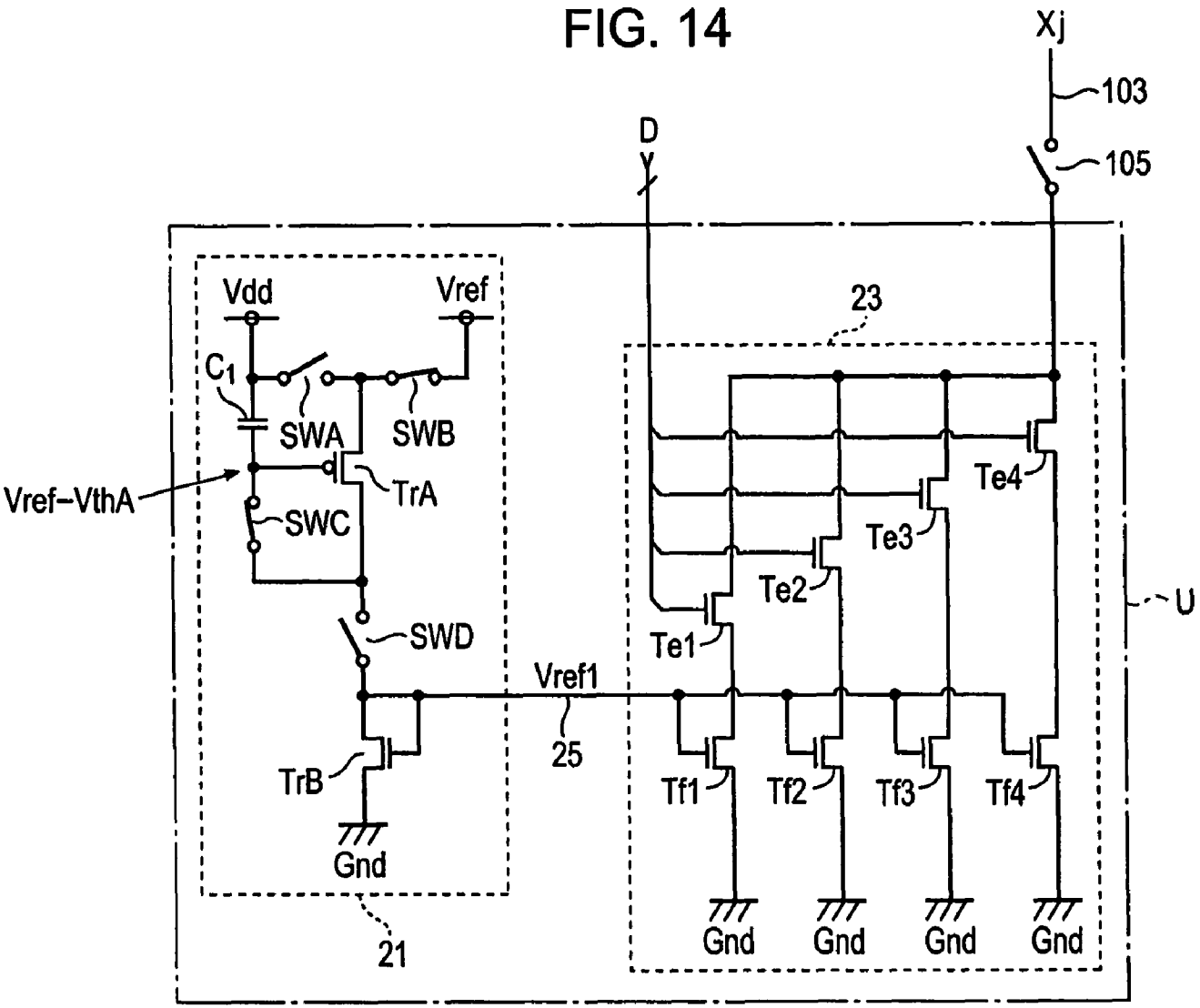
FIG. 14 is a circuit diagram illustrating a state of the unit circuit in a period B.
Figure 15:
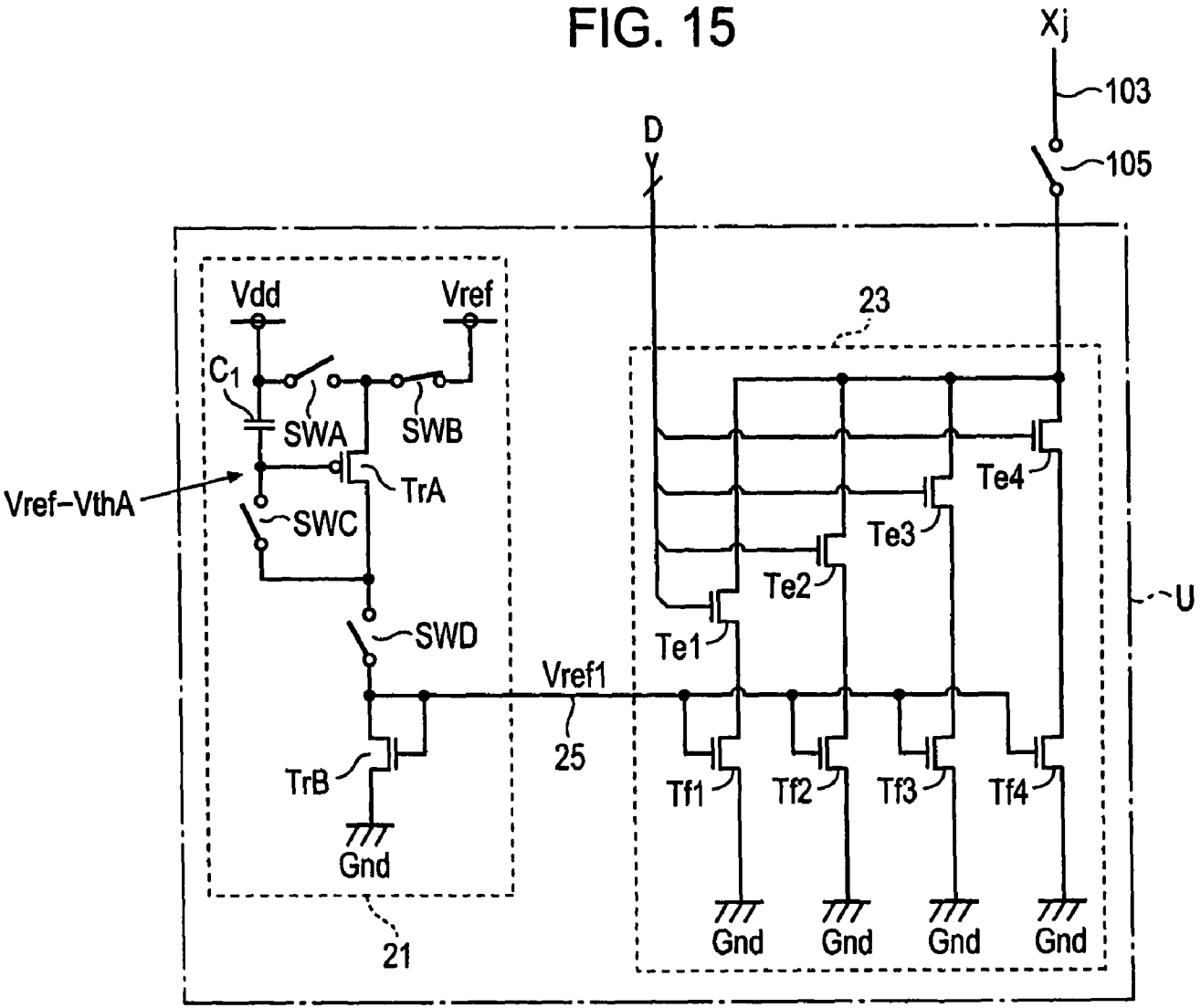
FIG. 15 is a circuit diagram illustrating a state of the unit circuit in a period C.
Figure 16:
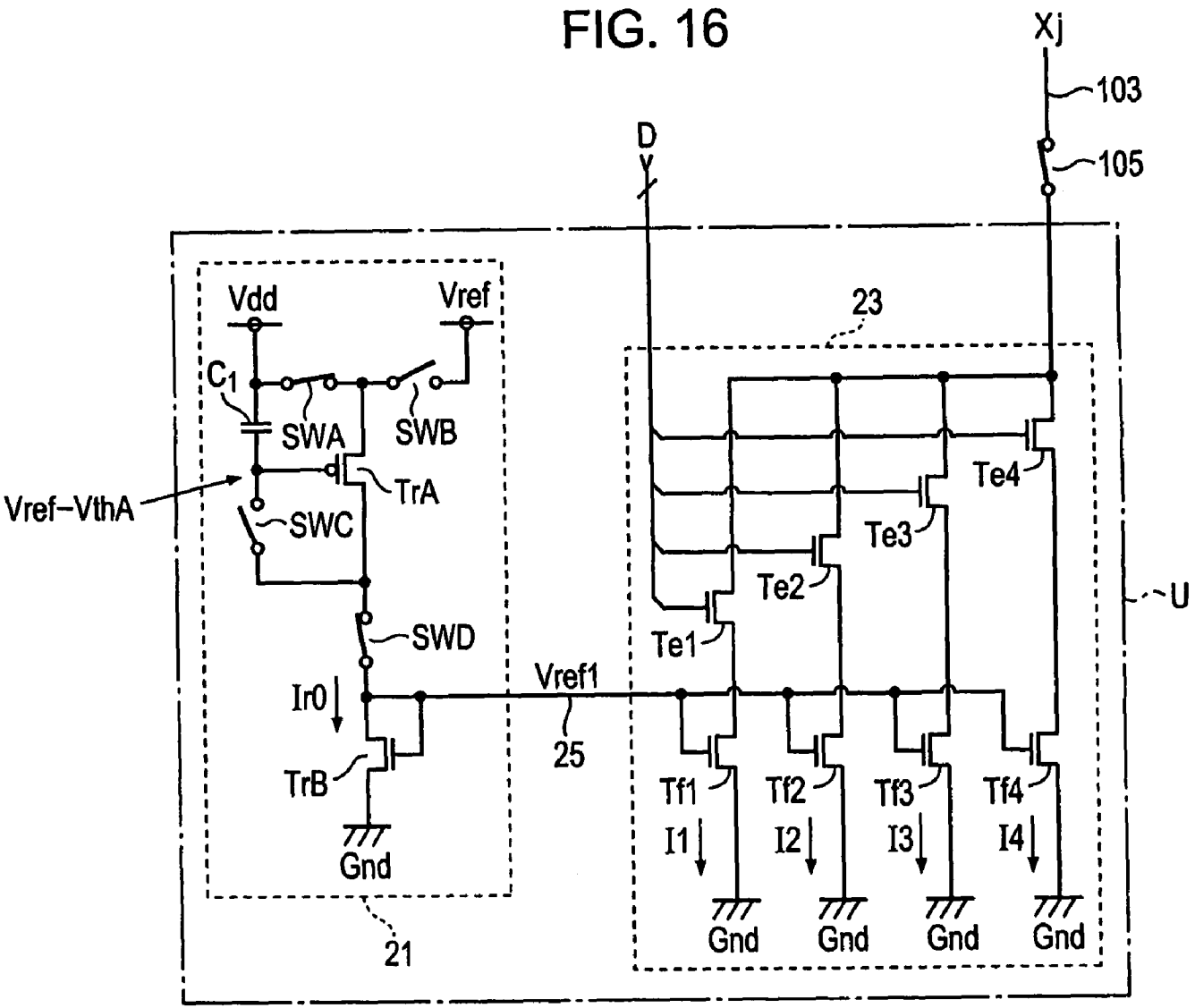
FIG. 16 is a circuit diagram illustrating a state of the unit circuit in a period D.

FIG. 12 is a timing diagram illustrating the operation of the reference voltage generating circuit 21. As shown in FIG. 12, the period when the reference voltage generating circuit 21 operates is divided into a period A (first period) from the time t0 to the time t1, a period B (second period) from the time t1 to time t2, a period C (third period) from the time t2 to the time t3, and a period D (fourth period) from the time t3 to the time t4. FIG. 13 is a circuit diagram illustrating a state of the unit circuit U in the period A, FIG. 14 is a circuit diagram illustrating a state of the unit circuit U in the period B, FIG. 15 is a circuit diagram illustrating a state of the unit circuit U in the period C, and FIG. 16 is a circuit diagram illustrating a state of the unit circuit U in the period D. Hereinafter, the operation of the reference voltage generating circuit 21 is divided into the period A to the period D and then is described.

Operation in Period A

First, as shown in FIG. 12, in the period A, the enable signal SENB is set to a low level, the control signal SA is set to a low level, the control signal SB is set to a high level, the control signal SC is set to a high level, and the control signal SD is set to a high level, respectively, by the control circuit 30. Accordingly, as shown in FIG. 13, the switching element SWA is switched to the disconnection state and the switching element SWB, the switching element SWC, and the switching element SWD are switched to the connection state. Therefore, the source terminal of the current generating transistor TrA is supplied with the potential Vref, the gate terminal and the drain terminal of the current generating transistor TrA are connected to each other (in a diode connection manner), and the drain terminal of the current generating transistor TrA is connected to the drain terminal of the voltage generating transistor TrB.

In this connection state, the potential of the gate terminal of the current generating transistor TrA becomes a potential determined by a ratio of ON resistances of the current generating transistor TrA and the voltage generating transistor TrB. The ration of ON resistances is determined as a ratio of gate widths, gate lengths, and mobility of the current generating transistor TrA and the voltage generating transistor TrB. For example, supposed that the gate width is 5 μm, the gate length is 10 μm, and the mobility is 0.5 in the current generating transistor TrA and the gate width is 5 μm, the gate length is 15 μm, and the mobility is 1.0 in the voltage generating transistor TrB, the ratio of the ON resistances of the current generating transistor TrA and the voltage generating transistor TrB is 4:3. Supposed that the potential Vref is 13V, the potential of the gate terminal of the current generating transistor TrA is Vref×3/(3+4)≈5.57V. In the period A, the reference voltage Vref1 output to the reference voltage line 25 is not set to a predetermined value yet, but since the switching elements 105 are in the disconnection state due to the enable signal SENB of a low level in the period A, unstable data signals Xj are not output to the data lines 103.

Operation in Period B

In the period B successive to the period A, as shown in FIG. 12, the enable signal SENB is allowed to keep a low level, the control signal SA is allowed to keep a low level, the control signal SB is allowed to keep a high level, the control signal SC is allowed to keep a high level, and the control signal SD is changed to the low level from the high level, respectively, by the control circuit 30. Accordingly, as shown in FIG. 14, the switching element SWD is switched to the disconnection state. The potential Vref is supplied to the source terminal of the current generating transistor TrA and the gate terminal and the drain terminal of the current generating transistor TrA are connected to each other (in a diode connection manner). Therefore, when the threshold value VthA of the current generating transistor TrA is VthA, the gate potential of the current generating transistor TrA gradually increases to "Vref−VthA".

Operation in Period C

In the period C successive to the period B, as shown in FIG. 12, the enable signal SENB is allowed to keep a low level, the control signal SA is allowed to keep a low level, the control signal SB is allowed to keep a high level, the control signal SD is allowed to keep a high level, and the control signal SC is changed to the low level from the high level, respectively, by the control circuit 30. Accordingly, as shown in FIG. 15, the switching element SWC is switched to the disconnection state and the gate terminal and the drain terminal of the current generating transistor TrA is disconnected from each other, the potential "Vref−VthA" is held in the capacitor C1.

Operation in Period D

In the successive period D, as shown in FIG. 12, the control signal SC is allowed to keep the low level, the enable signal SENB is changed from the low level to the high level, the control signal SA is changed from the low level to the high level, the control signal SB is changed from the high level to the low level, and the control signal SD is changed from the lower to the high level, respectively, by the control circuit 30. Accordingly, as shown in FIG. 16, the switching element SWA is switched to the connection state, the switching element SWB is switched to the disconnection state, the potential supplied to the source terminal of the current generating transistor TrA is changed from the potential Vref to the power source potential Vdd, the switching element SWD is switched to the connection state, and the drain terminal of the current generating transistor TrA and the drain terminal of the voltage generating transistor TrB are connected to each other. Since the potential "Vref−VthA" is held in the gate terminal of the current generating transistor TrA by the capacitor C1, the reference current Ir0 is generated toward the ground potential Gnd from the power source potential Vdd. The reference voltage Vref1 is supplied to the current output circuit 23 from the reference voltage line 25 by the voltage generating transistor TrB.

When the reference voltage Vref1 of the current output circuit 23 is supplied to the transistors Tf (Tf1 to Tf4) and the transistors Te (Te1 to Te4) are turned on correspondingly to the gray-scale data D, the current I (one or more kinds of current selected among I1 to I4) flows in the transistors Tf and a signal obtained by adding the current is supplied to the data lines 103 as the data signal Xj.

Supposed that the gain coefficient of the current generating transistor TrA is β, the threshold voltage of the current generating transistor TrA is VthA, and the gate-source potential of the current generating transistor TrA is Vgs, Vgs=Vdd−(Vref−VthA). Accordingly, the reference current Ir0 is obtained from $Ir1=(½)\times\beta\times(Vgs-VthA)^2=(½)\times\beta\times(Vdd-(Vref-VthA)-VthA)^2=(½)\times\beta\times(Vdd-Vref)^2$. That is, the reference current Ir0 is determined by the power source potential Vdd and the potential Vref without being affected by the threshold voltage VthA of the current generating transistor TrA.

The refresh operation in the blanking periods Hb (period A, period B, and period C) is performed before the potential "Vref−VthA" of the capacitor C1 is lower in the period D which is the horizontal scanning period H (from the time t4 to the time t7 in FIG. 12). The refresh operation is performed in the blanking period between the successive horizontal scanning periods or in the blanking period between the successive vertical scanning periods.

As described above, in the second embodiment, the reference current Ir0 (in addition, the reference voltage Vref1) is determined by the power source potential Vdd and the potential Vref without being affected by the threshold voltage VthA of the current generating transistor TrA. Accordingly, the deviation of the threshold voltage VthA due to the manufacturing processes or errors in characteristics due to the deviation can be reduced, thereby generating the reference current Ir0 having a predetermined current value (or the reference voltage Vref1 having a predetermined voltage value) with high accuracy. In addition, since the current value of the reference current Ir0 is frequently set to the predetermined value by performing the refresh operation plural times, it is possible to supply the stable reference voltage Vref1 to the current output circuit 23.

B-3. Modified Example of Second Embodiment

The second embodiment can be modified in various forms. Specific modified examples thereof can be exemplified as follows. The following modified examples may be appropriately combined.

B-3-1. First Modified Example

In the second embodiment, the configuration that one reference voltage generating circuit 21 and one current output circuit 23 are includes in each unit circuit U of the data-line driving circuit 20 has been exemplified. However, in the first modified example, a plurality of current output circuits 23 are connected to one reference voltage generating circuit 21, similarly to the configuration shown in FIG. 5.

Figure 17:
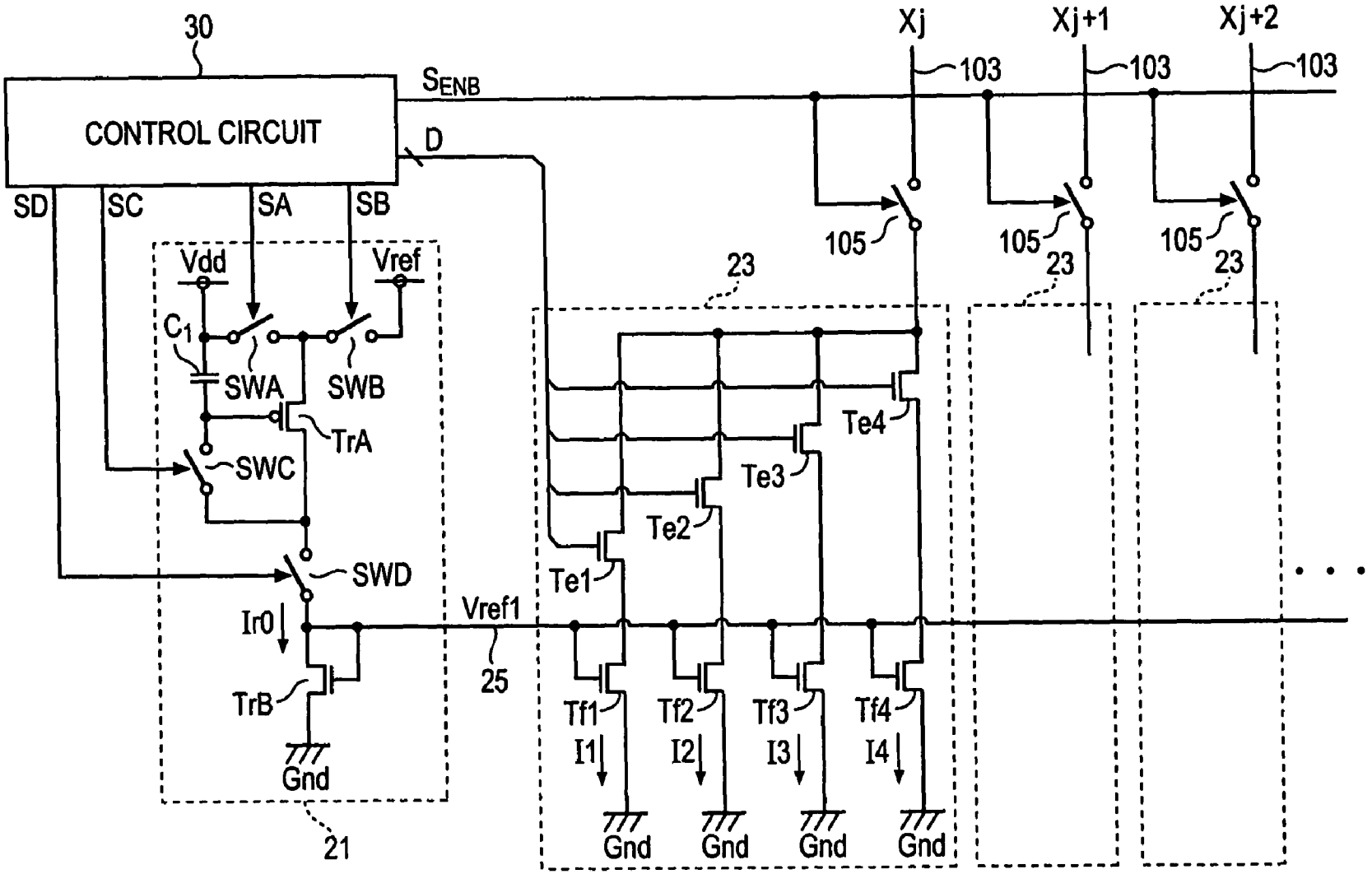
FIG. 17 is a circuit diagram illustrating a configuration of the data-line driving circuit according to the first modified example.

FIG. 17 is a circuit diagram illustrating a configuration of the data-line driving circuit 20 according to the first modified example. As shown in FIG. 17, the reference voltage line 25 connected to the drain terminal of the voltage generating transistor TrB of the reference voltage generating circuit 21 is connected in common to the gate terminals of the transistors Tf (Tf1 to Tf4) of the plurality of current output circuits 23. According to this configuration, it is possible to further reduce the circuit size in comparison with the configuration that one reference voltage generating circuit 21 is provided in each unit circuit U.

B-3-2. Second Modified Example

In the first embodiment, the configuration that one reference voltage generating circuit 21 is provided in one unit circuit U of the data-line driving circuit 20 has been exemplified. However, in the second modified example, any one of two reference voltage generating circuits 21 is selectively connected to the current output circuit 23, similarly to the configuration shown in FIG. 8.

Figure 18:
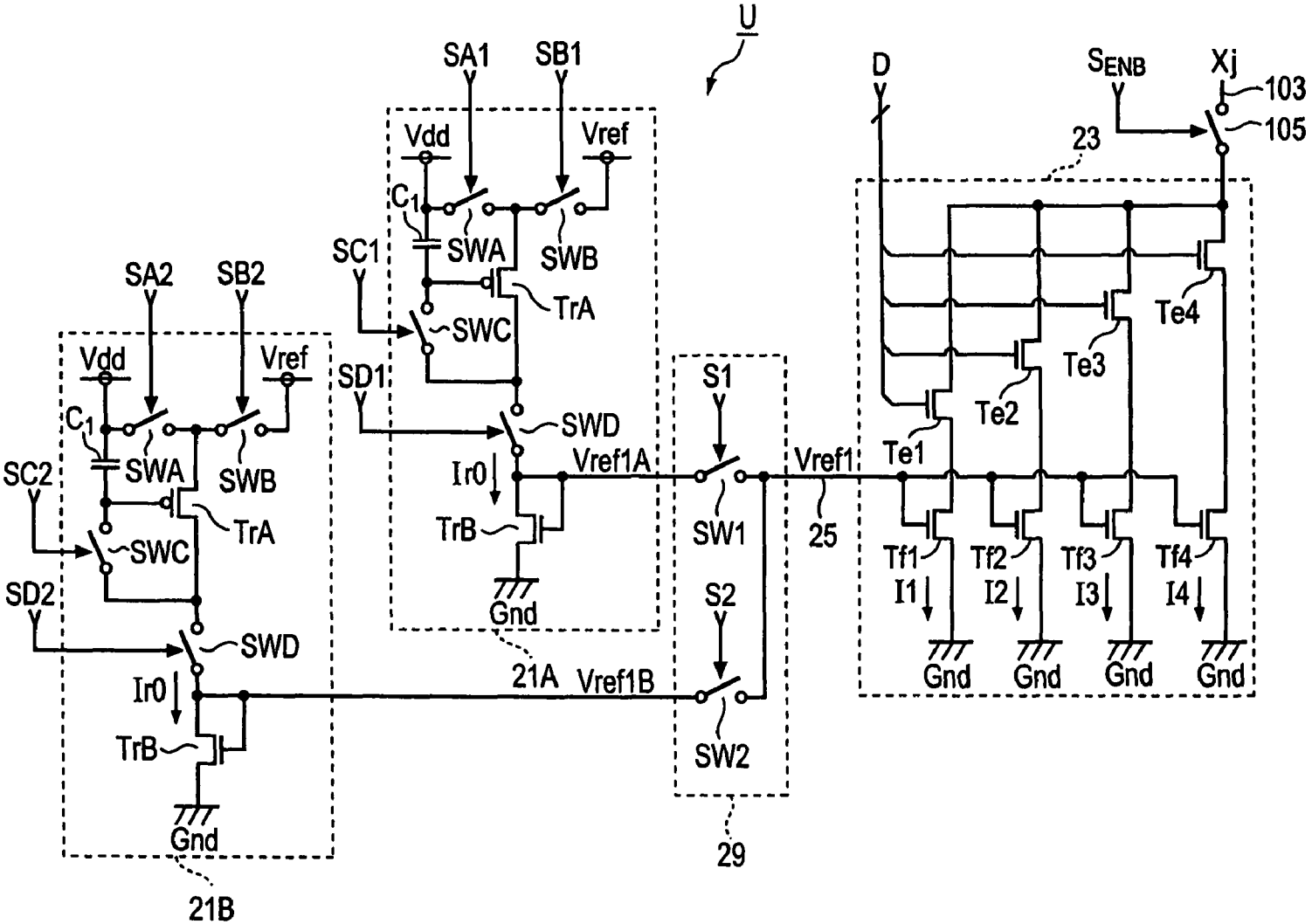
FIG. 18 is a circuit diagram illustrating a configuration of the data-line driving circuit according to the second modified example.

FIG. 18 is a circuit diagram illustrating a configuration of the data-line driving circuit 20 according to the second modified example. As shown in FIG. 18, the unit circuit U of the data-line driving circuit 20 includes two reference voltage generating circuits 21A and 21B, a selection circuit 29, and a current output circuit 23. The configurations of the reference voltage generating circuits 21A and 21B are similar to that of the reference voltage generating circuit 21 according to the second embodiment shown in FIG. 11.

The switching elements SWA, SWB, SWC, and SWD of the reference voltage generating circuit 21A are controlled by means of the control signals SA1, SB1, SC1, and SD1 from the control circuit 30, respectively. The switching elements SWA, SWB, SWC, and SWD of the reference voltage generating circuit 21B are controlled by means of the control signals SA2, SB2, SC2, and SD2 from the control circuit 30, respectively.

The selection circuit 29 has switching elements SW1 and Sw2. The switching element SW1, of which one terminal is connected to the gate terminal (reference voltage Vref1A) of the current generating transistor TrA of the reference voltage generating circuit 21A and the other terminal is connected to the reference voltage line 25, is switched to any one of the connection state and the disconnection state in accordance with the control signal S1 from the control circuit 30. The switching element SW2, of which one terminal is connected to the gate terminal (reference voltage Vref1B) of the current generating transistor TrA of the reference voltage generating circuit 21B and the other terminal is connected to the reference voltage line 25, is switched to any one of the connection state and the disconnection state in accordance with the control signal S2 from the control circuit 30.

Figure 19:
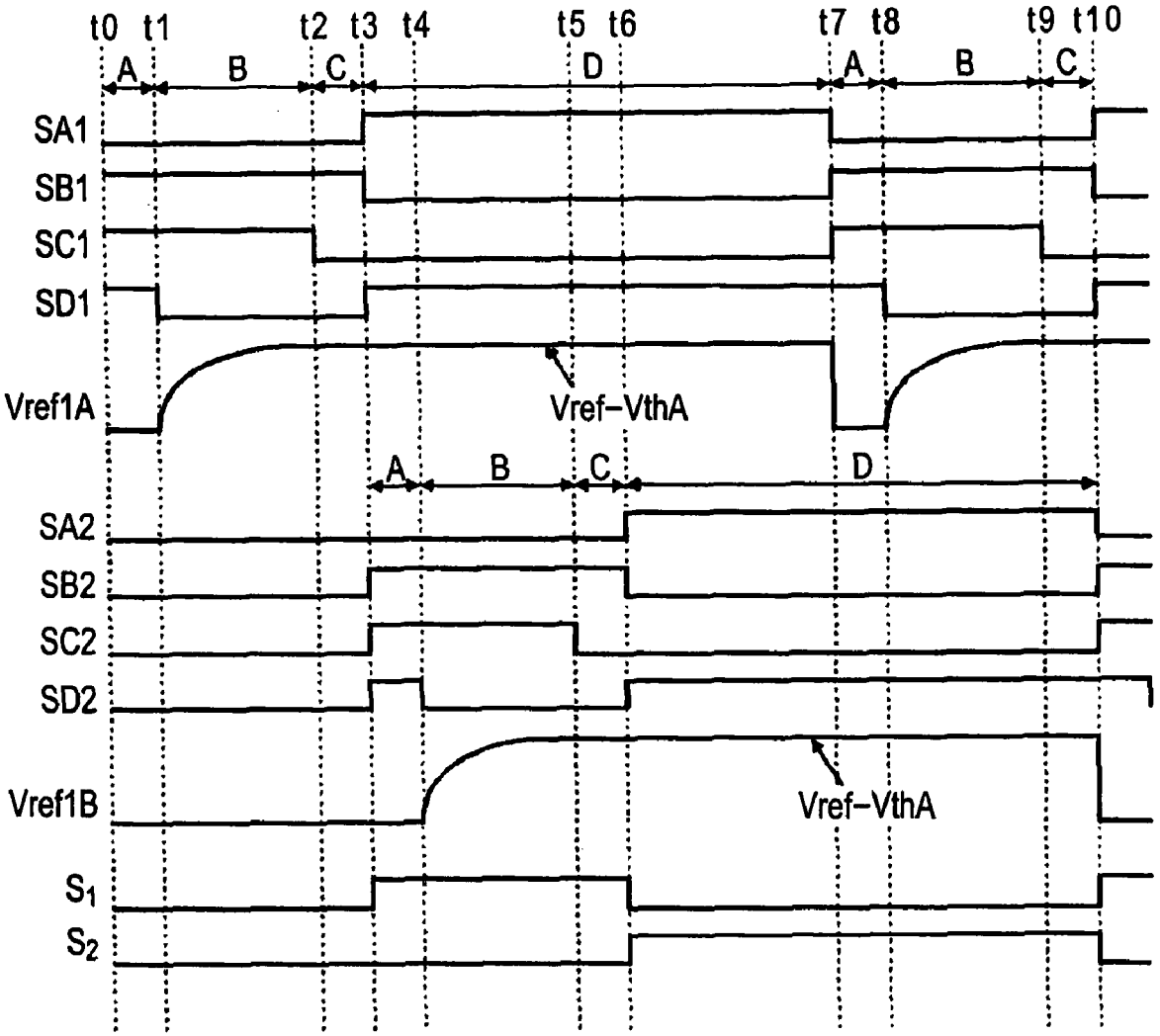
FIG. 19 is a timing diagram illustrating operations in the second modified example.

Next, operations of the reference voltage generating circuits 21A and 21B under the control of the control circuit 30 will be described with reference to FIGS. 18 and 19. FIG. 19 is a timing diagram illustrating operations of the reference voltage generating circuits 21A and 21B and the selection circuit 29 under the control of the control circuit 30. As shown in FIG. 19, the operation in which the reference voltage Vref1A is generated in the gate terminal of the current generating transistor TrA of the reference voltage generating circuit 21A in accordance with the control signals SA (SA1, SB1, SC1, and SD1) from the control circuit 30 is similar to the operation (the operation allowing the reference voltage generating circuit 21 to generate the reference voltage Vref1) described with reference to FIG. 12.

At the time t3 shown in FIG. 19, the reference voltage generating circuit 21A is in the period D and the gate potential Vref1A of the current generating transistor TrA of the reference voltage generating circuit 21A is held as Vref−VthA. At this time, the control signal S1 from the control circuit 30 is changed from the low level to the high level, the switching element SW1 of the selection circuit is switched to the connection state, and thus the gate potential Vref1A of the current generating transistor TrA of the reference voltage generating circuit 21A is supplied to the reference voltage line 25. On the other hand, the control signal S2 has the low level.

On the other hand, the reference voltage generating circuit 21B is in the period A at the time t3, is in the period B at the time t4, is in the period C at the time t5, and is in the period D at the time t6. At the time t6, the gate potential Vref1B of the current generating transistor TrA of the reference voltage generating circuit 21B is held as Vref−VthA. At this time, the control signal S2 from the control circuit 30 is changed from the low level to the high level, the switching element SW2 of the selection circuit 29 is switched to the connection state, and thus the gate potential Vref1B of the current generating transistor TrA of the reference voltage generating circuit 21B is supplied to the reference voltage line 25. On the other hand, the control signal S1 is changed from the high level to the low level and the switching element SW1 of the selection circuit 29 is switched to the disconnection state.

At the time t7, the reference voltage generating circuit 21A is in the period A again, is in the period D at the time t10, the control signal S1 is changed from the low level to the high level, the switching element SW1 of the selection circuit 29 is switched to the connection state, and thus the gate potential Vref1A of the current generating transistor TrA of the reference voltage generating circuit 21A is supplied to the reference voltage line 25. On the other hand, the control signal S2 is changed from the high level to the low level and the switching element SW2 of the selection circuit 29 is switched to the disconnection state.

Thereafter, the operations from the time t3 to the time t10 are repeated and the gate potential Vref1A of the current generating transistor TrA of the reference voltage generating circuit 21A and the gate potential Vref1B of the current generating transistor TrA of the reference voltage generating circuit 21B are alternately supplied to the reference voltage line 25.

According to the above-described configuration, it is possible to always supply the stable reference voltage to the reference voltage line 25 by controlling two reference voltage generating circuits 21A and 21B to alternately operate. Even when the blanking period cannot be set to a long period of time, it is possible to always supply the stable reference voltage to the reference voltage line 25.

B-3-3. Third Modified Example

In the second embodiment, the configuration that one unit circuit U of the data-line driving circuit 20 includes the reference voltage generating circuit 21 and the current output circuit 23 has been exemplified. However, in the third modified example, a PWM circuit of a pulse width modulation (PWM) type of driving the pixel circuits 40 by outputting the reference current Ir0 generated by the current generating transistor TrA directly to the data lines 103 is employed.

Figure 20:
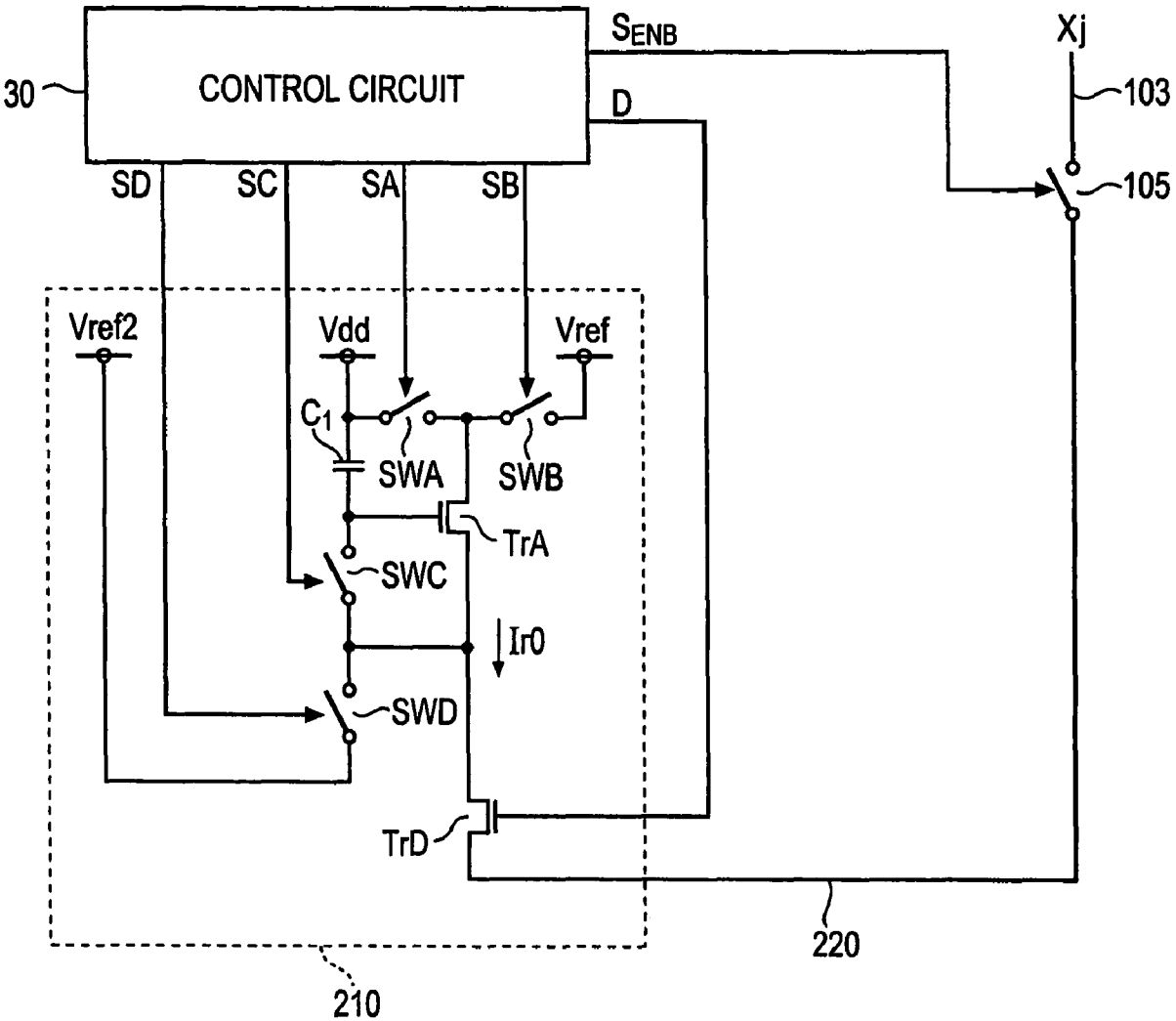
FIG. 20 is a circuit diagram illustrating a configuration of the data-line driving circuit according to the third modified example.

FIG. 20 is a circuit diagram illustrating a configuration of the data-line driving circuit 20 according to the third modified example. As shown in FIG. 20, one unit circuit U of the data-line driving circuit 20 includes one reference current generating circuit 210. The reference current generating circuit 210 includes a current generating transistor TrA, a capacitor C1, four switching elements SWA, SWB, SWC, and SWD, and a transistor TrD. The current generating transistor TrA, the capacitor C1, and three switching elements SWA, SWB, and SWC have the same configurations as those of the reference voltage generating circuit 21 shown in FIG. 11.

One terminal of the switching element SWD is connected to the drain terminal of the current generating transistor TrA and the other terminal is supplied with a potential Vref2 lower than the difference in threshold voltage between the potential Vref and the current generating transistor TrA from the power supply circuit (not shown).

The transistor TrD is an n-channel type transistor of which the source terminal is connected to the drain terminal of the current generating transistor TrA, the drain terminal is connected to one terminal of the switching element 105, and the gate terminal is supplied with the gray-scale data D defining the pulse width of the data signal Xj from the control circuit 30. That is, the data signal Xj output to the data lines 103 through a reference current line 220 from the transistor TrD is a pulse signal of which the current value is the reference current Ir0 in the pulse width corresponding to the gray-scale data D.

B-3-4. Fourth Modified Example

In the third modified example, the configuration that the PWM circuit is employed as the reference current generating circuit 210 has been exemplified. However, in the fourth modified example, a current adding circuit of a pulse amplitude modulation type in which the pixel circuits 40 is driven by selectively outputting a plurality of reference current Ir0 generated from the individual current generating transistors TrA is employed.

Figure 21:
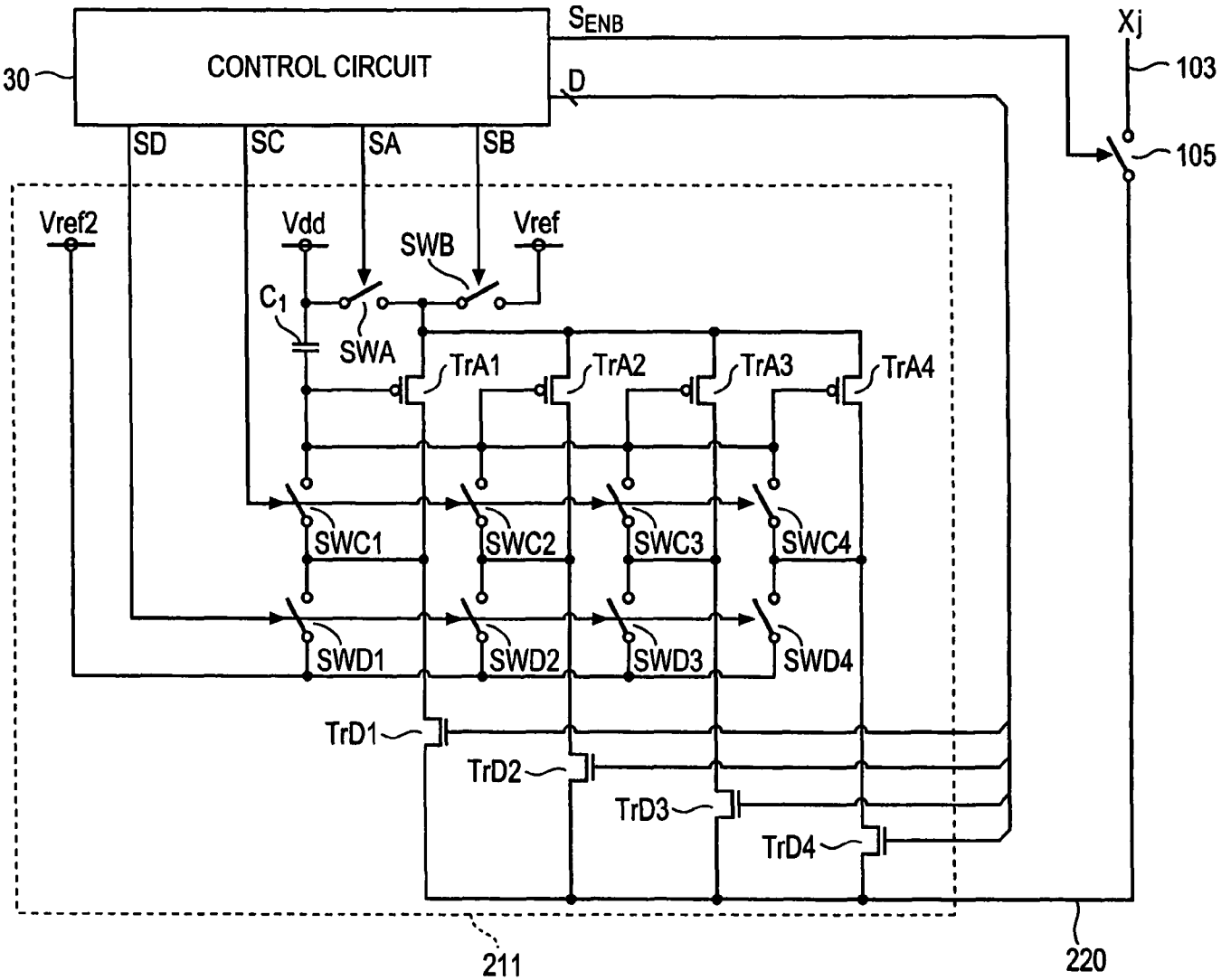
FIG. 21 is a circuit diagram illustrating a configuration of the data-line driving circuit according to the fourth modified example.

FIG. 21 is a circuit diagram illustrating a configuration of one unit circuit U according to the fourth modified example. As shown in FIG. 21, the unit circuit U according to the fourth modified example includes one reference current generating circuit 211. The reference current generating circuit 211 includes a capacitor C1, two switching elements SWA and SWB, four current generating transistors TrA (TrA1 to TrA4), four switching elements SWC (SWC1 to SWC4), four switching elements SWD (SWD1 to SWD4), and four transistors TrD (TrD1 to TrD4).

In the four current generating transistors TrA, the source terminals thereof are connected to each other and the gate terminals are connected in common to one terminal of the capacitor C1. The drain terminals of the current generating transistors TrA are connected to the source terminal of one transistor TrD disposed at the rear stage thereof. The gate terminals of the four transistors TrD are supplied with bits of the gray-scale data D and the drain terminals are connected in common to the switching element 105. That is, the unit circuit U according to the fourth modified example has a configuration that four circuits including the current generating transistor TrA, the transistor TrD, and the switching elements SWC and SWD are disposed in parallel.

Each of the four switching elements SWC (SWC1 to SWC4), of which one terminal is connected to the gate terminal of the corresponding current generating transistor TrA (TrA1 to TrA4) and the other terminal is connected to the drain terminal of the corresponding current generating transistor TrA (TrA1 to TrA4), is switched to any one of the connection state and the disconnection state in accordance with the control signal SC from the control circuit 30. Each of the four switching elements SWD (SWD1 to SWD4), of which one terminal is connected to the drain terminal of the corresponding current generating transistor TrA (TrA1 to TrA4) and the other terminal is connected to the potential Vref2, is switched to any one of the connection state and the disconnection state in accordance with the control signal SD from the control circuit 30.

When at least one TrD1 of the four transistors is selected in accordance with the gray-scale data D, the reference current Ir0 generated from the current generating transistor TrA corresponding to the transistor TrD1 is added in the reference current line 220 and then output to the data lines 103 as the data signal Xj. In this way, in the fourth modified example, the four transistors TrD1 to TrD4 serve as a circuit (signal output unit) for outputting the data signal Xj corresponding to the reference current Ir0 to the data lines 103. According to this configuration, since the current output circuit 23 shown in FIG. 11 is not required, the area required for arranging the unit circuits U can be reduced.

B-3-5. Other Modified Examples

The second embodiment and the modified examples thereof may be further modified as follows.

In the second embodiment, the configuration that the refresh operation is performed in the blanking period between the successive horizontal scanning periods or in the blanking period between the successive vertical scanning periods has been exemplified. However, the refresh operation may be performed once every plural horizontal scanning periods H or plural vertical scanning periods. For example, the refresh operation may be performed every time when all the scanning lines 101 of the pixel area P are selected a predetermined times.

Although it has been described in the second embodiment that the current generating transistor TrA is composed of the p-channel type transistor and the voltage generating transistor TrB is composed of the n-channel type transistor, the current generating transistor TrA may be composed of an n-channel type transistor and the voltage generating transistor TrB may be composed of a p-channel type transistor.

Although it has been described in the second embodiment that, in the period A, the potential of the gate terminal of the current generating transistor TrA is set by switching on the switching element SWD and connecting the drain terminal of the current generating transistor TrA and the drain terminal of the voltage generating transistor TrB to each other, a voltage for turning on the current generating transistor TrA may be supplied to the gate terminal and the drain terminal of the current generating transistor TrA. In this configuration since the period necessary for the refresh operation can be changed to (Period B+Period C) from (Period A+Period B+Period C), it is possible to shorten the period necessary for the refresh operation by the period A.

In the second embodiment, the configuration that two kinds of signals of the control signal SA and the control signal SB are output from the control circuit 30 has been exemplified. However, only one of the control signal SA and the control signal SB may be output from the control circuit 30 and the other may be generated by inverting the logical level with an inverter.

Although it has been described in the second modified example that two reference voltage generating circuits 21A and 21B and the selection circuit 29 are provided as shown in FIG. 18, the reference current may be alternately output by using the voltage generating transistor TrB in common to the reference voltage generating circuits 21A and 21B. In the second modified example, the configuration that two reference voltage generating circuits 21A and 21B are connected to one current output circuit 23 through the selection circuit 29 has been exemplified. However, as exemplified in the first modified example, two reference voltage generating circuits 21A and 21B may be connected to a plurality of current output circuits 23 through the selection circuit 29.

Although it has been described in the above-described examples that the capacitor C1 is connected to the gate terminal of the current generating transistor TrA, it is not limited to the capacitor only if it can hold the voltage of the gate terminal of the current generating transistor TrA.

C. Third Embodiment

Next, a third embodiment of the invention will be described. In the third embodiment, the elements similar to those of the first embodiment are denoted by the same reference numerals and description thereof is appropriately omitted.

C-1. Configuration of Third Embodiment

Figure 22:
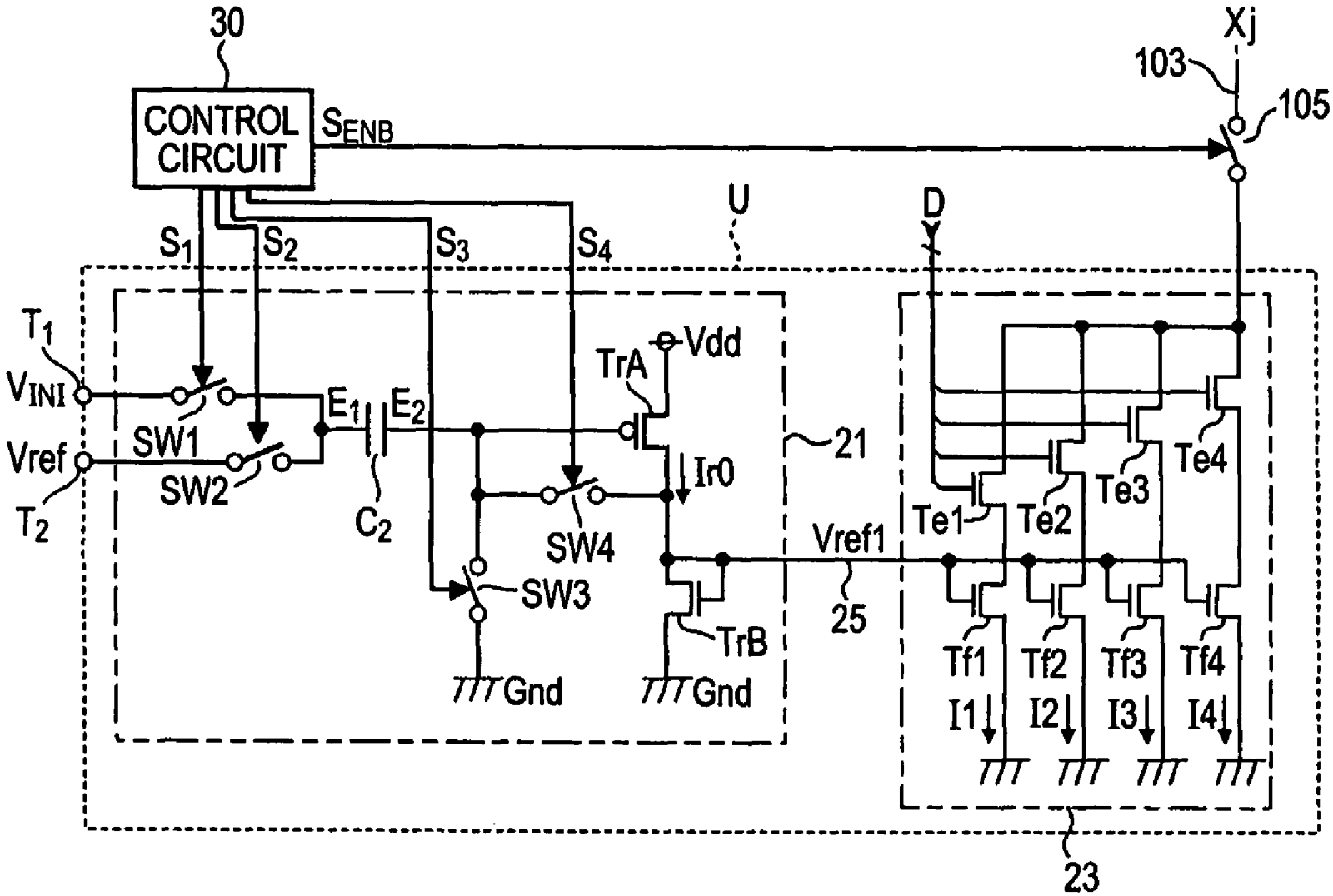
FIG. 22 is a circuit diagram illustrating a configuration of a data-line driving circuit according to a third embodiment.

FIG. 22 is a circuit diagram illustrating a configuration of a unit circuit U in the data-line driving circuit 20 according to the third embodiment. As shown in the figure, each unit circuit U includes a reference voltage generating circuit 21 and a current output circuit 23. The configuration of the current output circuit 23 is similar to that of the first embodiment. As shown in FIG. 22, the reference voltage generating circuit 21 according to the third embodiment includes a p-channel type current generating transistor TrA, an n-channel type voltage generating transistor TrB, a capacitor C2, and four switching elements SW (SW1 to SW4).

The current generating transistor TrA serves to generate a reference current Ir0 and the source terminal thereof is supplied with the power source potential Vdd. The voltage generating transistor TrB serves to generate a reference voltage Vref1 corresponding to the reference current Ir0 and output the reference voltage to a reference voltage line 25. The gate terminal and the drain terminal of the voltage generating transistor TrB are connected in common to the drain terminal of the current generating transistor TrA and the reference voltage line 25. The source terminal of the voltage generating transistor TrB is grounded.

The capacitor C2 is a capacitor in which a dielectric substance is interposed between a first electrode E1 and a second electrode E2. The first electrode E1 is connected to a terminal T1 through the switching element SW1 and is connected to a terminal T2 through the switching element SW2. The terminal T1 is supplied with a voltage VINI from a power supply circuit (not shown). Similarly, the terminal T2 is supplied with a voltage Vref. On the other hand, the second electrode E2 is connected to the gate terminal of the current generating transistor TrA. A holding capacitor for holding the voltage Vg of the gate terminal of the current generating transistor TrA may be interposed between the gate terminal and the source terminal of the current generating transistor TrA.

The switching element SW3 is interposed between the gate terminal of the current generating transistor TrA and the ground potential Gnd. The switching element SW4 is interposed between the gate terminal and the drain terminal of the current generating transistor TrA. Accordingly, when the switching element SW4 is changed to the ON state, the current generating transistor TrA is connected in a diode manner.

The respective switching elements SW are a switch which is changed to the ON state (electrical connection state) when the control signals S (S1 to S4) supplied thereto are changed to a high level and is changed to the OFF state (electrically disconnected state) when the control signals are changed to a low level. For example, when the switching element SW1 is turned on when the control signal S1 is changed to a high level and is turned off when the control signal is changed to a low level. The respective control signals S are supplied from the control circuit 30.

C-2. Operations of Third Embodiment

Figure 23:
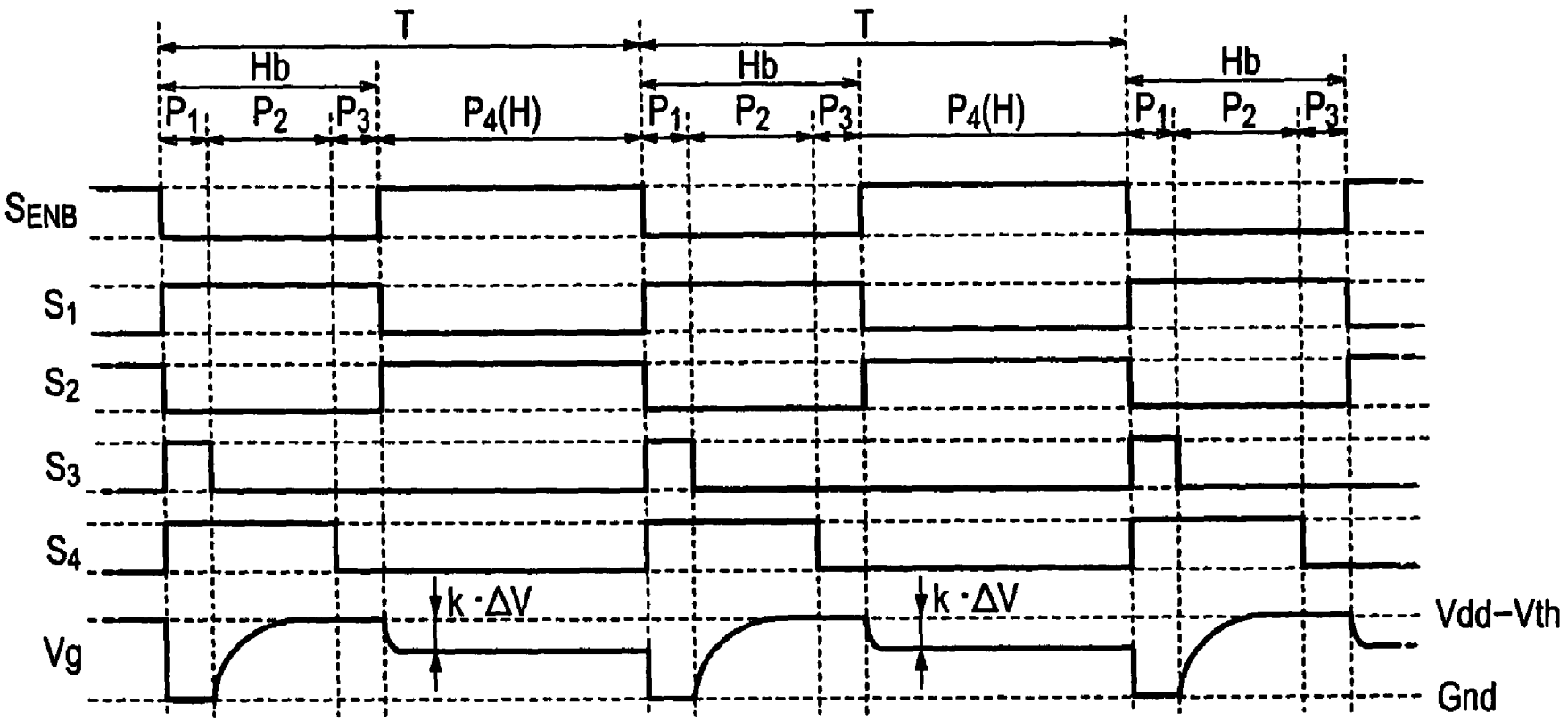
FIG. 23 is a timing diagram illustrating operations of the data-line driving circuit.
Figure 24A:
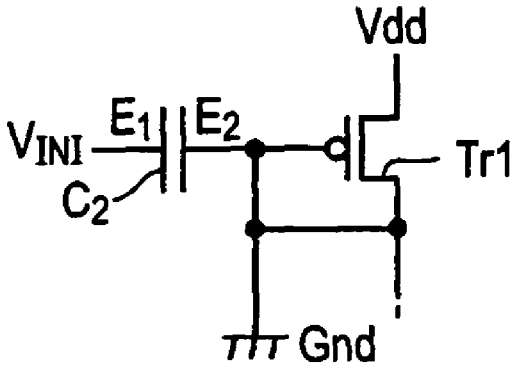
FIG. 24 is an equivalent circuit diagram illustrating states of a reference voltage generating circuit in the respective periods.
Figure 24B:
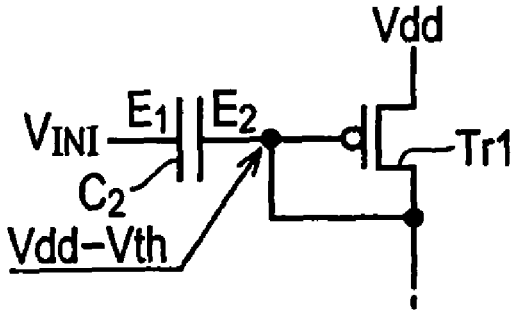
Figure 24C:
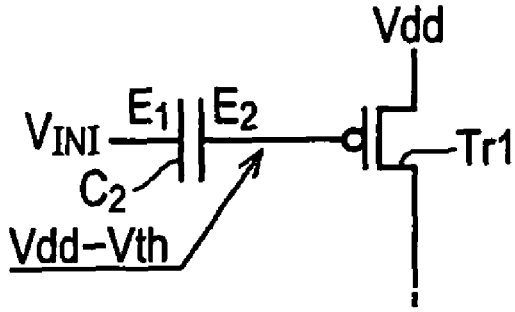
Figure 24D:
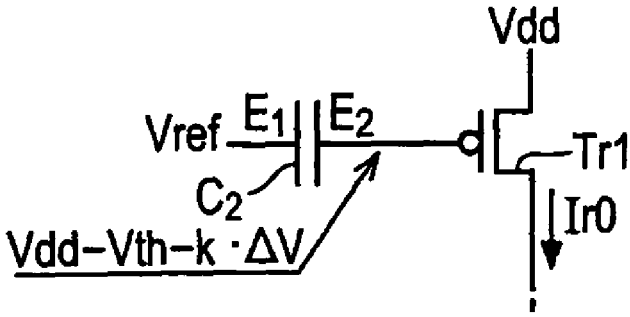

FIG. 23 is a timing diagram illustrating operations of the reference voltage generating circuit 21 according to the third embodiment. In the third embodiment, the refresh operation is performed plural times with a cycle T including a horizontal scanning period H (fourth period P4) when the enable signal SENB has the high level and a blanking period Hb when the enable signal SENB has the low level. The blanking period Hb is divided into a first period P1, a second period P2, and a third period P3. The first period P1 and the second period P2 are periods for compensating for the error (deviation) of the threshold voltage Vth of the current generating transistor TrA and the third period P3 and the fourth period P4 (horizontal scanning period H) are periods for actually generating the reference current Ir0.

The control signal S1 keeps the high level in the blanking period Hb and keeps the low level in the horizontal scanning period H. On the other hand, the control signal S2 is a signal obtained by inverting the logical level of the control signal S1, keeps the low level in the blanking period Hb, and keeps the high level in the horizontal scanning period H. The control signal S3 keeps the high level in the first period P1 of the blanking period Hb and keeps the low level in the other periods. The control signal S4 keeps the high level in the first period P1 and the second period P2 of the blanking period Hb and keeps the low level in the other periods.

Next, a specific operation of the reference voltage generating circuit will be described with reference to FIGS. 23 and 24. FIG. 24 is an equivalent circuit diagram illustrating the reference voltage generating circuit 21 in each of the first to fourth periods P1 to P4.

As shown in FIG. 23, in the first period P1, the control signals S1, S3, and S4 keep the high level and the control signal S2 keeps the low level. Accordingly, the switching elements SW1, SW3, and SW4 are changed to the ON state and the switching element SW2 keeps the OFF state. That is, as equivalently shown in (a) of FIG. 24, the voltage INI is supplied to the first electrode E1 of the capacitor C2 and the voltage Vg of the second electrode E2 (the gate terminal of the current generating transistor TrA) of the capacitor C2 is lowered to the ground potential Gnd.

In the second period P2 successive to the first period P1, the control signal S3 is changed to the low level and the other controls signals keep the same level as that in the first period P1. Accordingly, as equivalently seen in (b) of FIG. 24, since the switching element Sw3 is changed to the OFF state, the supply of the ground potential Gnd to the second electrode E2 is stopped. As a result, the voltage Vg of the second electrode E2 gradually increases from the ground potential Gnd set in the first period P1 and as shown in FIG. 23 and (b) of FIG. 24, is stabilized when the difference value Vdd−Vth between the power source voltage Vdd and the threshold voltage Vth of the current generating transistor TrA is reached. That is, in the second period P2, the voltage Vg of the second electrode E2 is set to a voltage value based on the power source potential Vdd and the threshold voltage Vth.

In the third period P3 successive to the second period P2, the control signal S4 is changed to the low level and the other control signals S keep the same level as that in the second period P2. Accordingly, as shown in (c) of FIG. 24, since the switching element SW4 is changed to the OFF state, the diode connection of the current generating transistor TrA is released. In the third period P3, the voltage Vg of the second electrode E2 is kept at "Vdd−Vth."

Next, in the fourth period P4 successive to the third period P3, the control signal S1 is changed to the low level from the high level and the control signal S2 is changed to the high level from the low level. Accordingly, the voltage supplied to the first electrode E1 is changed to the voltage Vref of the terminal T2 from the voltage VINI of the terminal T1. In the fourth period P4, since the second electrode E2 is electrically floating, the voltage Vg of the second electrode E2 is changed by the level corresponding to the variation ΔV (=VINI−Vref) of the voltage of the first electrode E1 by means of the capacitive coupling in the capacitor C2. More specifically, the variation in voltage of the second electrode E2 is expressed as "k·ΔV" by using the gate capacitance of the current generating transistor TrA or parasitic capacitances around the transistor (electrostatic capacitance of a holding capacitor in a configuration that the holding capacitor is interposed between the gate terminal and the source terminal of the current generating transistor TrA). That is, as shown in (d) of FIG. 24, in the fourth period P4, since the changed voltage Vg (=Vdd−Vth−k·ΔV) is supplied to the gate terminal, the current generating transistor TrA is changed to the ON state and the reference current Ir0 flows between the source terminal and the drain terminal thereof.

Supposed that the current generating transistor TrA operated in a saturated region in the fourth period P4, the reference current Ir0 is expressed by the following expression.

$$Ir0=(\beta/2)\cdot(Vgs-Vth)^2$$

The voltage Vgs in this expression denotes the gate-source voltage of the current generating transistor TrA. Now, in the fourth period P4, since the voltage Vg of the gate terminal is set to "Vdd−Vth−k·ΔV", the gate-source voltage Vgs is expressed as "Vdd−(Vdd−Vth−k·ΔV)." By inserting the voltage Vgs into the expression, the following expression can be derived.

$$Ir0=(\beta/2)\cdot k\cdot\Delta V$$

That is, the reference current Ir0 in the third embodiment does not rely on the threshold voltage Vth of the current generating transistor TrA, but is set to a current value based on the difference value ΔV between the voltage Vref and the voltage VINI. Accordingly, the reference voltage Vref1 generated from the voltage generating transistor TrB on the basis of the reference current Ir0 does not rely on the error of the threshold value Vth of the current generating transistor TrA. In the third embodiment, the coefficient k for determining the reference current Ir0 relies on the capacitance of the capacitor C2. However, the error of the capacitance of the capacitor C2 in each unit circuit U can be suppressed more easily than the error of the threshold voltage Vth. Therefore, even when the error of the capacitance of the capacitor C2 is considered, it can be said in the third embodiment that the error of the threshold voltage Vth can be compensated for more easily than the related art.

In the third embodiment, the refresh operation (operation of setting the reference current Ir0 to a predetermined value) is also performed plural times. Accordingly, for example, even when the voltage Vg of the gate terminal of the current generating transistor TrA or the reference voltage Vref1 is changed due to the noise or the like, the value is returned to a predetermined value in the subsequent blanking period Hb. Therefore, according to the third embodiment, it is possible to obtain the same advantages as the first embodiment. In the third embodiment, since the capacitor C1 is used in common for the setting and the holding of the voltage Vg due to the capacitive coupling, it is possible to reduce the circuit size in comparison with a configuration that an additional capacitor is disposed for the setting and the holding of the voltage Vg.

C-3. Modified Example of Third Embodiment

The third embodiment can be modified in various forms. Specific modified examples thereof can be exemplified as follows. The following examples may be appropriately combined.

C-3-1. First Modified Example

Figure 25:
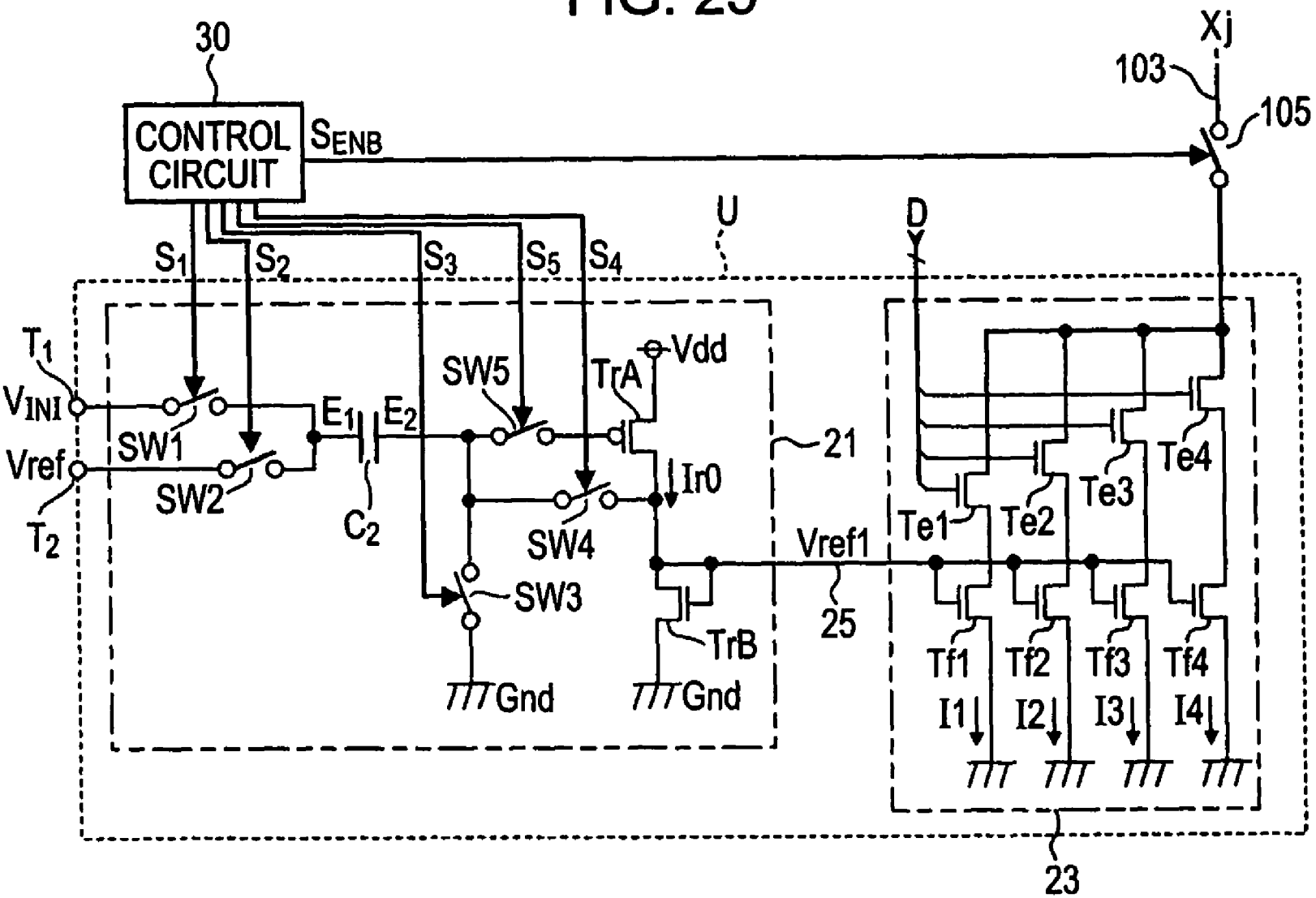
FIG. 25 is a circuit diagram illustrating a configuration of a data-line driving circuit according to a first modified example of the third embodiment.

FIG. 25 is a circuit diagram illustrating a configuration of a unit circuit U according to the first modified example. As shown in FIG. 25, the reference voltage generating circuit 21 in the unit circuit U according to the first modified example includes a switching element SW5 in addition to the elements shown in FIG. 22. The switching element SW5 is a switch which is interposed between the gate terminal of the current generating transistor TrA and the second electrode E2 of the capacitor C2 and which controls the electrical connection between both. The switching element SW5 is turned on when the control signal S5 supplied from the control circuit 30 has a high level and is turned off when the control signal S5 has a low level.

Figure 26:
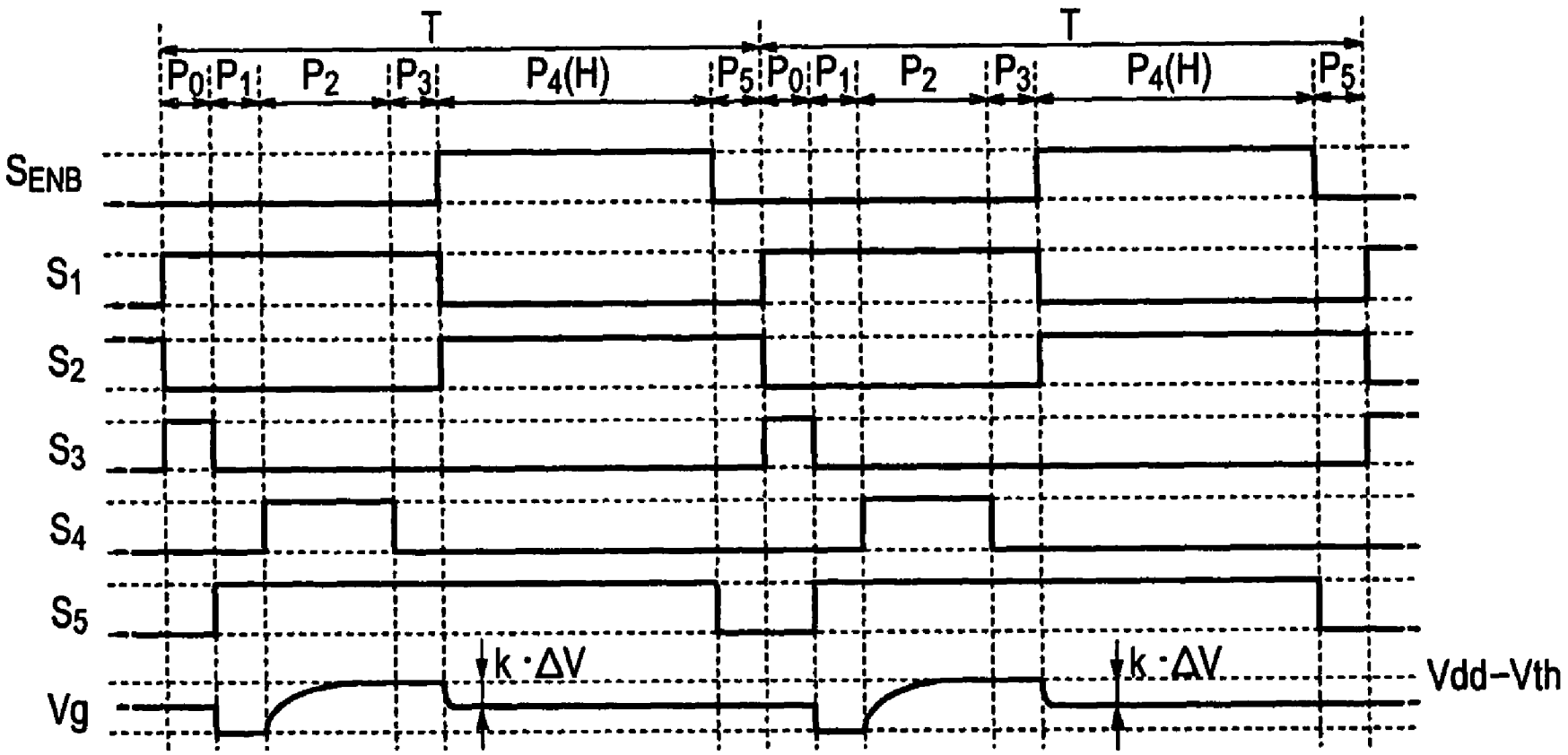
FIG. 26 is a timing diagram illustrating operations of the reference voltage generating circuit.
Figure 27A:
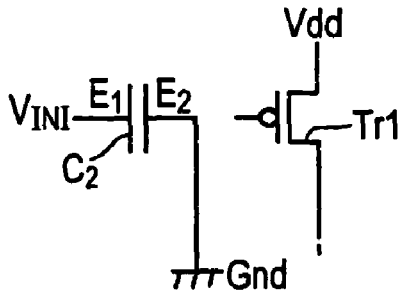
FIG. 27 is an equivalent circuit diagram illustrating states of the reference voltage generating circuit in the respective periods.
Figure 27B:
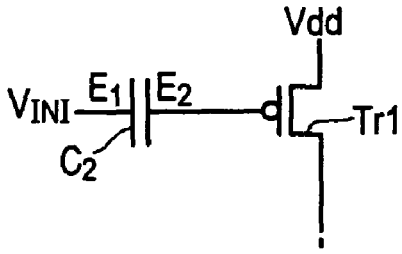
Figure 27C:
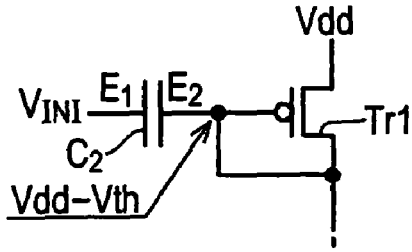
Figure 27D:
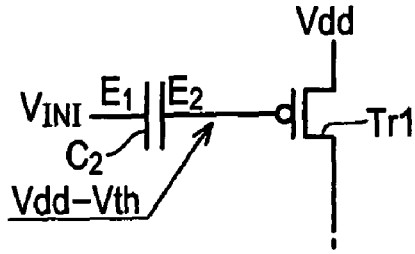
Figure 27E:
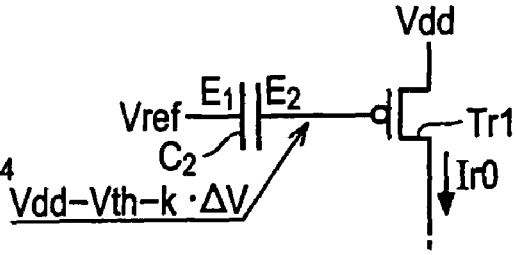
Figure 27F:
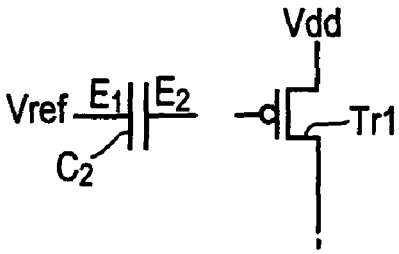

Next, FIG. 26 is a timing diagram illustrating an operation of the reference voltage generating circuit 21 according to the first modified example. In the first modified example, the refresh operation is performed plural times every predetermined cycle T, similarly to the third embodiment. The cycle T includes the period P0 and the first to fifth periods P1 to P5. The period from the period P0 to the second period P2 serves as a period for compensating for the error of the threshold voltage Vth of the current generating transistor TrA and the third period P3 and the fourth period P4 (horizontal scanning period) serve as a period for actually generating the reference current Ir0. Hereinafter, the specific operation of the reference voltage generating circuit 21 will be described with reference to FIGS. 23 and 24. FIG. 24 is an equivalent circuit diagram illustrating the reference voltage generating circuit 21 in the respective periods from the period P0 to the fifth period P5.

As shown in FIG. 26, in the period P0, the control signals S1 and S3 are changed to the high level and the control signals S2, S4, and S5 are changed to the low level. Accordingly, as shown in (a) of FIG. 27, in the period P0, after the gate terminal of the current generating transistor TrA and the second electrode E2 of the capacitor C2 are electrically disconnected from each other, the voltage VINI is supplied to the first electrode E1 and the ground potential Gnd is supplied to the second electrode E2. In the period P0, the voltage Vg of the gate terminal of the current generating transistor TrA is kept at the voltage supplied thereto at the end time of the fifth period P5 by means of capacitive components (for example, the gate capacitance of the current generating transistor TrA) other than the capacitor C2. The voltage is a voltage turning on the current generating transistor TrA.

In the first period P1 successive to the period P0, as shown in FIG. 26, the control signal S3 is changed to the low level and the control signal S5 is changed to the high level. Accordingly, as shown in (b) of FIG. 27, the supply of the ground potential Gnd to the second electrode E2 and the gate terminal of the current generating transistor TrA and the second electrode E2 of the capacitor C2 are electrically connected to each other. Since the second electrode E2 is grounded in the period P0, the voltage Vg of the gate terminal of the current generating transistor TrA connected to the second electrode E2 in the first period P1 is changed to a voltage value (a voltage value turning on the current generating transistor TrA) lower than that in the period P0.

In the second period P2 successive to the first period P1, as shown in (c) of FIGS. 26 and 27, the control signal S4 is changed to the high level to turn on the switching element SW4. Accordingly, similarly to the third embodiment, the voltage Vg gradually increases from the voltage value set in the first period P1 and is stabilized when the difference value Vdd−Vth between the power source potential Vdd and the threshold voltage Vth of the current generating transistor TrA is reached. In the third period successive to the second period P2, since the control signal S4 is changed to the low level, the diode connection of the current generating transistor TrA is released (see (c) of FIG. 27).

In the fourth period P4, similarly to the third embodiment, since the voltage supplied to the first electrode E1 is changed by "ΔV" from the voltage VINI to the voltage Vref, the voltage Vg of the gate terminal of the current generating transistor TrA is changed by "k·ΔV." Accordingly, for the same reason as the third embodiment, the reference current Ir0 not relying on the threshold voltage Vth flows between the source terminal and the drain terminal of the current generating transistor TrA, as shown in (d) of FIG. 27.

In the fifth period P5 successive to the fourth period P4, since the control signal S5 keeps the low level, the gate terminal of the current generating transistor TrA is electrically disconnected from the second electrode E2. Therefore, the voltage Vg of the gate terminal is kept with the voltage value in the fourth period P4 to the end time of the period P0.

As described above, in the first modified example, since the gate terminal of the current generating transistor TrA is not grounded in any period, the current generating transistor TrA is not completely turned on. Accordingly, according to the first modified example, compared with the third embodiment in which the gate terminal of the current generating transistor TrA is grounded in the first period P1, the current flowing in the current generating transistor TrA at the time of compensating for the threshold voltage Vth can be suppressed and as a result, the power consumption can be reduced. Since the gate terminal of the current generating transistor TrA is not grounded, it is possible to reduce the period of time when the voltage Vg of the gate terminal reaches "Vdd−Vth" in the second period P2, in comparison with the third embodiment.

C-3-2. Second Modified Example

In FIG. 22 or 25, the configuration that the voltage Vg of the gate terminal of the current generating transistor TrA is held by the capacitance component other than the capacitor C2 (for example, the gate capacitance of the current generating transistor TrA) has been exemplified. However, a configuration that a capacitor for holding the voltage Vg is disposed independently may be employed. For example, similarly to the capacitor C1 (FIG. 3) of the first embodiment, a capacitor for holding the voltage Vg may be interposed between the gate terminal of the current generating transistor TrA and a predetermined line (for example, a power supply line or a ground line), independently of the capacitor C2.

C-3-3. Other Modified Examples

The modified examples of the first embodiment or the second embodiment can be employed in the present embodiment. For example, the configuration that each current output circuit 23 has one reference voltage generating circuit 21 has been exemplified in FIG. 22 or 25. However, a plurality of current output circuits 23 may be connected to one reference voltage generating circuit 21 (that is, one reference voltage generating circuit 21 may be shared by a plurality of current output circuits 23). As exemplified in FIG. 8 or 18, the reference voltages generated from the plurality of reference voltage generating circuit 21 (or the corresponding reference current) may be selectively output to the current output circuit.

D. Other Embodiments

The respective embodiments (embodiments and modified examples thereof) may be modified in various forms in addition to the examples exemplified above. Specific modified examples may be exemplified as follows.

The configuration of the pixel circuit 40 may be arbitrarily changed. For example, the pixel circuit 40 of a current programming type has been exemplified in the above-mentioned embodiment, but a pixel circuit of a voltage programming type in which the brightness (gray scale) of the OLED elements 41 is controlled in accordance with the voltage value of the data signal Xj may be employed. In this configuration, for example, a signal obtained by converting the current value output from the current output circuit 23 of the respective embodiments into a voltage value through the use of a current-to-voltage conversion circuit is output as the data signal Xj to the respective data lines 103.

In the above-mentioned embodiments, the active matrix electro-optical device in which the switching elements (for example, Tr1 to Tr4 in FIG. 2) for controlling the OLED elements 41 are arranged in the pixel circuits 40 has been exemplified. However, the invention can apply to a passive matrix electro-optical device in which the pixel circuits 40 do not have the switching elements.

In the first embodiment, the configuration that the refresh operation is performed in both of the initialization period PINI and the respective blanking periods Hb has been exemplified. However, a configuration that the refresh operation is performed only in the blanking periods Hb may be employed. In the above-mentioned embodiments, the time for performing the refresh operation is not limited to the initialization period PINI or the blanking periods Hb. In the invention, it is sufficient only if the refresh operation is performed plural times.

The example described with reference to FIG. 20 can be similarly applied to the first embodiment or the third embodiment. For example, in the first embodiment, the reference current Ir0 (or the mirror current Ir1) flowing in the current generating transistor Tb may be output to the data lines 103 as the data signal Xj with a time density (pulse width) corresponding to the gray-scale data D. The same is true of the third embodiment and the reference current Ir0 flowing in the current generating transistor TrA of FIG. 22 may be output to the data lines 103 as the data signal Xj with a time density corresponding to the gray-scale data D.

In the above-mentioned embodiments, the electro-optical device 1 employing the OLED elements 41 has been exemplified, but the invention can apply to an electro-optical device other electro-optical elements. For example, the invention can apply to a variety of electro-optical devices such as a display device employing inorganic EL elements, a field emission display (FED) device, a surface-conduction electro-emitter display (SED) device, a ballistic electron surface emitting display (BSD) device, a display device employing light emitting diodes, and a printing head of an optical printer or an electronic copier.

E. Applications

Figure 28:
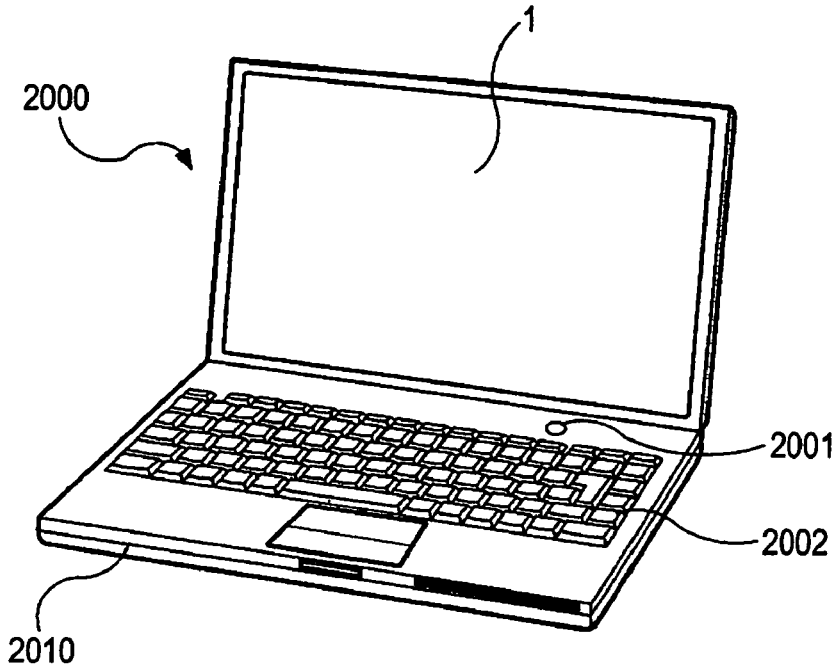
FIG. 28 is a perspective view illustrating an example (personal computer) of an electronic apparatus according to the invention.

Next, electronic apparatuses employing the electro-optical device according to the invention will be described. FIG. 28 is a perspective view illustrating a configuration of a mobile personal computer employing the electro-optical device 1 according to an embodiment as a display unit. The personal computer 2000 includes the electro-optical device 1 as a display unit and a body unit 2010. The body unit 2010 is provided with a power source switch 2001 and a keyboard 2002. Since the electro-optical device 1 employs OLED elements 41, it is possible to display a screen easily visible with a wide viewing angle.

Figure 29:
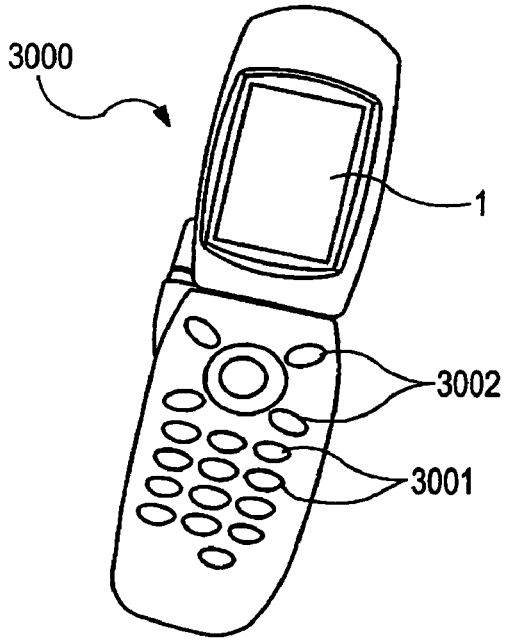
FIG. 29 is a perspective view illustrating an example (mobile phone) of the electronic apparatus according to the invention.

FIG. 29 shows a configuration of a mobile phone employing the electro-optical device 1 according to an embodiment is shown. The mobile phone 3000 includes a plurality of manipulation buttons 3001, a scroll button 3002, and the electro-optical device 1 as a display unit. A screen displayed on the electro-optical device 1 is scrolled by manipulating the scroll button 3002.

Figure 30:
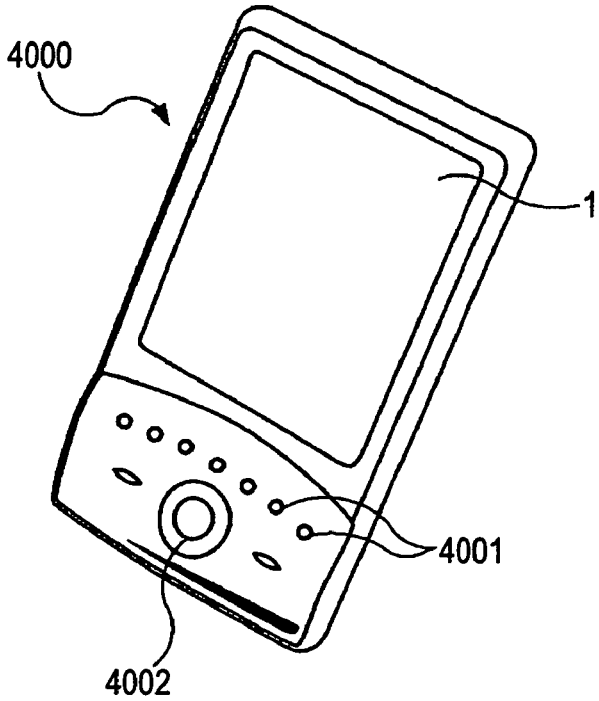
FIG. 30 is a perspective view illustrating an example (personal digital assistant) of the electronic apparatus according to the invention.

FIG. 30 shows a configuration of a personal digital assistant (PDA) employing the electro-optical device 1 according to an embodiment. The personal digital assistant 4000 includes a plurality of manipulation buttons 4001, a power source switch 4002, and the electro-optical device as a display unit. By manipulating the power source switch 4002, a variety of information such as an address book and a schedule pocketbook is displayed on the electro-optical device 1.

In addition to the electronic apparatuses shown in FIGS. 28 to 30, examples of the electronic apparatus employing the electro-optical device according to the invention can include a digital still camera, a television, a video camera, a car navigation apparatus, a phasor, an electronic pocketbook, an electronic paper, an electronic calculator, a word processor, a work station, a television phone, a POS terminal, a printer, a scanner, a copier, a video player, an apparatus having a touch panel, and the like.

What is claimed is:

1. A drive circuit of an electro-optical device comprising electro-optical elements of which each gray scale is controlled in accordance with a data signal output to a data line, the driving circuit comprising:

a reference current generating unit that generates a reference current;

a signal output unit that generates the data signal corresponding to a current value of the reference current on the basis of gray-scale data and outputs the generated data signal to the data line;

a data line switch that turns ON and OFF an output of the data signal output to a data line, a compensation transistor coupled to a current mirror circuit, the current mirror circuit biased with a current mirror reference voltage circuit; and a voltage supply circuit that performs the refresh operation of supplying an ON voltage, allowing the compensation transistor to be turned on, to the gate terminal of the compensation transistor plural times, and turns on the current mirror reference voltage circuit, wherein the compensation transistor is coupled to the voltage supply circuit, the data line switch is turned OFF during an entire period that the voltage supply circuit supplies an ON voltage, the reference current generating unit performs a refresh operation of setting the current value of the reference current to a predetermined value plural times, and the reference current generating unit comprises a switching element that controls an electrical connection and disconnection between a voltage supply line and a compensation transistor.

2. The drive circuit of an electro-optical device according to claim 1, wherein the reference current generating unit comprises:

the compensation transistor of which a first terminal is supplied with a voltage and of which a second terminal and a gate terminal are electrically connected to each other;

a capacitor that holds the voltage of the gate terminal of the compensation transistor; and wherein the reference current generating unit generates the reference current corresponding to the voltage held by the capacitor, a first terminal of the capacitor is electrically connected to the gate terminal of the compensation transistor, and a second terminal of the capacitor is directly connected to an electrical ground.

3. The drive circuit of an electro-optical device according to claim 2, further comprising a comparison unit that compares the voltage of the gate terminal of the compensation transistor with a predetermined voltage, wherein the voltage supply circuit supplies the ON voltage to the gate terminal of the compensation transistor at the time corresponding to the comparison result of the comparison unit.

4. The drive circuit of an electro-optical device according to claim 1, wherein the reference current generating unit includes:

a current generating transistor having a gate terminal, a first terminal, and a second terminal; and a capacitor that holds the voltage of the gate terminal of the current generating transistor, and wherein the refresh operation includes:

a compensation operation of setting the voltage of the gate terminal to a voltage value based on a first voltage and a threshold voltage of the current generating transistor by supplying the first voltage to the second terminal in the state where the gate terminal is electrically connected to the first terminal and then allowing the capacitor to hold the set voltage; and a generation operation of generating the reference current corresponding to the voltage held by the capacitor in the compensation operation between the first terminal and the second terminal, by supplying a second voltage different from the first voltage to the second terminal in the state where the gate terminal is electrically disconnected from the first terminal.

5. The drive circuit of an electro-optical device according to claim 4, wherein the compensation operation includes:

a first operation of supplying the first voltage to the second terminal and supplying a predetermined voltage to the gate terminal in the state where the gate terminal and the first terminal are electrically connected to each other in a first period; and a second operation of setting the voltage of the gate terminal to a voltage value based on the first voltage and a threshold voltage of the current generating transistor by stopping the application of the predetermined voltage to the gate terminal in the state where the gate terminal and the first terminal are electrically connected to each other and allowing the capacitor to hold the set voltage in a second period successive to the first period, and wherein the generation operation includes:

a third operation of electrically disconnecting the gate terminal and the first terminal from each other in a third period successive to the second period; and a fourth operation of generating the reference current corresponding to the voltage held by the capacitor between the first terminal and the second terminal by supplying the second voltage to the second terminal in a fourth period successive to the third period.

6. The drive circuit of an electro-optical device according to claim 5, wherein the reference current generating unit includes a voltage generating transistor in which the voltage of a gate terminal thereof is set to a reference voltage in accordance with the reference current flowing between a first terminal supplied with a third voltage and a second terminal connected to the gate terminal, wherein the signal output unit generates a data signal corresponding to the reference voltage of the gate terminal of the voltage generating transistor on the basis of the gray-scale data and outputs the generated data signal to the data line, wherein the first operation includes an operation of setting the voltage of the gate terminal of the current generating transistor to the predetermined voltage in accordance with an ON resistance ratio between the current generating transistor and the voltage generating transistor, the first voltage, and the third voltage, by electrically connecting the first terminal of the current generating transistor and the second terminal of the voltage generating transistor, and wherein the second operation includes an operation of stopping the supply of the predetermined voltage by electrically disconnecting the first terminal of the current generating transistor and the second terminal of the voltage generating transistor from each other.

7. The drive circuit of an electro-optical device according to claim 4, wherein the reference current generating unit includes a plurality of the current generation transistors of which the gate terminal are connected to the capacitor in common, and wherein the signal output unit selects one or more current generating transistors among the plurality of current generating transistors in accordance with gray-scale data and outputs the total current flowing between the first terminal and the second terminal in the one or more current generating transistors as a data signal.

8. The drive circuit of an electro-optical device according to claim 1, further comprising:

a current generating transistor having a gate terminal, a first terminal, and a second terminal supplied with a predetermined voltage; and a capacitor having a first electrodes and a second electrode connected to the gate terminal of the current generating transistor, wherein the refresh operation includes:

a compensation operation of supplying a voltage based on the predetermined voltage and a threshold voltage of the current generating transistor to the second electrode, by electrically connecting the gate terminal and the first terminal of the current generating transistor to each other in the state where a first voltage is supplied to the first electrode; and a generation operation of changing the voltage of the second terminal on the basis of a difference between the first voltage and a second voltage from the voltage set in the compensation operation by switching the voltage of the first electrode to the second voltage different from the first voltage in the state where the gate terminal and the first terminal of the current generating transistor are electrically disconnected from each other and then generating the reference current corresponding to the changed voltage of the second terminal between the first terminal and the second terminal.

9. The drive circuit of an electro-optical device according to claim 8, wherein the compensation operation includes:

a first operation of supplying the first voltage to the first electrode and supplying a third voltage to the second electrode in the state where the second electrode and the gate terminal of the current generating transistor are electrically disconnected from each other in a first period;

a second operation of connecting the second electrode to the gate terminal of the current generating transistor after stopping the supply of the third voltage to the second electrode in a second period successive to the first period; and a third operation of setting the voltage of the second electrode to a voltage in accordance with the predetermined voltage and the threshold voltage of the current generating transistor by connecting the gate terminal and the first terminal of the current generating transistor to each other in a third period successive to the second period, and wherein the generation operation includes:

a fourth operation of electrically disconnecting the gate terminal and the first terminal of the current generating transistor from each other in a fourth period successive to the third period; and a fifth operation of generating the reference current between the first terminal and the second terminal by changing the voltage of the first electrode to the second voltage in a fifth period successive to the fourth period.

10. The drive circuit of an electro-optical device according to claim 1, comprising a plurality of the reference current generating units; and a selection unit selecting any of the plurality of reference current generating units, wherein the signal output unit generates the data signal corresponding to the reference current generated by the reference current generating unit selected by the selection unit on the basis of gray-scale data and outputs the generated data signal to the data line.

11. The drive circuit of an electro-optical device according to claim 10, wherein each of the plurality of reference current generating units performs the refresh operation at the times different from each other.

12. The drive circuit of an electro-optical device according to claim 1, wherein the reference current generating unit performs the refresh operation every predetermined time.

13. The drive circuit of an electro-optical device according to claim 1, wherein the reference current generating unit performs the refresh operation in a blanking period between successive horizontal scanning periods or in a blanking period between successive vertical scanning periods.

14. The drive circuit of an electro-optical device according to claim 1, wherein the reference current generating unit performs the refresh operation at the time before the signal output unit starts its operation and at the time after the signal output unit starts its operation.

15. An electro-optical device comprising:

a plurality of electro-optical elements of which each gray scale is controlled in accordance with a data signal output to a data line; and the circuit according to claim 1.

16. An electronic apparatus comprising the electro-optical device according to claim 15.

17. The drive circuit of an electro-optical device according to claim 1, further comprising:

a threshold voltage of the compensation transistor is substantially equal to a threshold voltage of a transistor in the current mirror circuit.

* * * * *